US005999210A

United States Patent [19]

Nemiroff et al.

[11] Patent Number: 5,999,210

[45] Date of Patent: Dec. 7, 1999

[54] MILITARY RANGE SCORING SYSTEM

[75] Inventors: Robert V. Nemiroff; Kevin P. McGoohan, both of Las Vegas; Pete A. Siebold, North Las Vegas, all of Nev.

[73] Assignee: Proteus Corporation, Albuquerque, N.Mex.

[21] Appl. No.: 08/864,851

[22] Filed: May 29, 1997

Related U.S. Application Data

[60] Provisional application No. 60/018,849, May 30, 1996.

[51] Int. Cl.[6] ..... H04N 7/18

[52] U.S. Cl. ..... 348/135; 348/139; 348/211

[58] Field of Search ..... 348/169, 135, 348/136, 137, 138, 139, 140, 141, 142, 211, 212, 213; 702/150; 356/3, 3.1, 3.11, 3.12, 3.14, 4.02, 11; H04N 7/18

[56] References Cited

U.S. PATENT DOCUMENTS

| | | | |
|---|---|---|---|
| 3,793,481 | 2/1974 | Ripley et al. | 348/139 |
| 4,155,096 | 5/1979 | Thomas et al. . | |
| 4,222,564 | 9/1980 | Allen et al. . | |
| 4,225,867 | 9/1980 | Gell . | |
| 4,315,689 | 2/1982 | Goda . | |
| 4,333,106 | 6/1982 | Löwe . | |
| 4,349,838 | 9/1982 | Daniel . | |
| 4,350,881 | 9/1982 | Knight et al. . | |
| 4,439,156 | 3/1984 | Marshall et al. . | |
| 4,478,581 | 10/1984 | Goda . | |
| 4,611,993 | 9/1986 | Brown . | |
| 4,622,458 | 11/1986 | Boeck et al. . | |
| 4,672,438 | 6/1987 | Plante | 348/121 |
| 4,689,016 | 8/1987 | Eichweber . | |
| 4,695,256 | 9/1987 | Eichweber . | |
| 4,739,329 | 4/1988 | Ward et al. . | |
| 4,955,812 | 9/1990 | Hill . | |
| 5,025,424 | 6/1991 | Rohrbaugh . | |
| 5,141,175 | 8/1992 | Harris . | |
| 5,228,854 | 7/1993 | Eldridge . | |
| 5,285,397 | 2/1994 | Heier | 348/139 |
| 5,291,262 | 3/1994 | Dunne | 356/5.06 |
| 5,359,920 | 11/1994 | Muirhead et al. . | |
| 5,393,064 | 2/1995 | Beard, III et al. . | |
| 5,432,546 | 7/1995 | Cargill . | |
| 5,521,634 | 5/1996 | McGary . | |
| 5,528,518 | 6/1996 | Bradshaw et al. . | |
| 5,644,386 | 7/1997 | Jenkins et al. . | |
| 5,689,445 | 11/1997 | Vogt | 702/150 |

*Primary Examiner*—Howard Britton
*Attorney, Agent, or Firm*—Jeffrey D. Myers; Deborah A. Peacock

[57] ABSTRACT

A military range scoring system with a plurality of imagers capable of viewing reference points and impact points for ordinance aimed at the reference points, imager position controllers, and data processors and video monitors for processing and viewing data received from said imagers, and communication links between the components. The imagers are preferably infrared or near-infrared, and the system manually and/or automatically scores impacts by digital signal processing of imager data.

105 Claims, 29 Drawing Sheets

(FIGURE INTENTIONALLY OMITTED)

FIG-22

(FIGURE INTENTIONALLY OMITTED)

FIG-29

MILITARY RANGE SCORING SYSTEM

CROSS-REFERENCE TO RELATED APPLICATIONS

This application claims the benefit of the filing of Provisional application Ser. No. 60/018,849, entitled "Tactical Range Infrared Scoring System", filed on May 30, 1996, the specification of which is incorporated by reference.

COPYRIGHTS

A portion of the disclosure of this patent document and of the provisional patent application to which it claims priority, contains material which is subject to copyright protection. The owner has no objection to the facsimile reproduction of the patent document or the patent disclosure, as it appears in the Patent and Trademark Office patent file or records, but otherwise reserves all copyright rights whatsoever.

BACKGROUND OF THE INVENTION

1. Field of the Invention (Technical Field)

The present invention relates to scoring systems for military ranges.

2. Background Art

The armed services are required to continuously train and test the capability of troops to accurately and effectively deliver various types of ordinance to targets under battlefield conditions. Current methods used by the various services are limited in scope and capability. The shift to more extensive use of nighttime engagements has heretofore required the use in training of low level explosives (spotting charges) to determine points of impact. These charges are expensive and present both safety and environmental hazards. Many types of munitions cannot at present be scored in training scenarios.

The prior art in this area includes the following: U.S. Pat. No. 4,155,096, to Thomas et al, relates to laser bore-sighting of sensors. U.S. Pat. No. 4,222,564, to Alan et al, relates to vibration sensing of impacts. U.S. Pat. No. 4,315,689, to Goda, relates to simulated firings of sight-guided missiles employing painting of the target with laser light for a period of time. U.S. Pat. No. 4,333,106, to Love, relates solely to airbornes targets. U.S. Pat. No. 4,349,838, to Daniel, relates to laser bore-sighting of sensors. U.S. Pat. No. 4,350,881, to Knight et al, relates to detection of the pressure wave of a projectile. U.S. Pat. No. 4,439,156, to Marshall et al, relates to simulated environments and weapons firings. U.S. Pat. No. 4,622,458, to Boeck et al, relates to a system which determines trajectories of objects employing a plurality of mobile data acquisition systems connected to a central station. U.S. Pat. No. 4,478,581, to Goda, relates to simulation of firings of ballistic ammunition using lasers. U.S. Pat. No. 4,611,993, to Brown, relates to a system requiring a vertical projection screen. U.S. Pat. No. 4,689,016, to Eichweber, relates only to simulations of firearms. U.S. Pat. No. 4,695,256, to Eichweber, relates only to firearms simulations requiring a retro-reflector. U.S. Pat. No. 4,739,329, to Ward et al, relates to a system requiring radar. U.S. Pat. No. 4,955,812, to Hill, relates only to firearms simulations. U.S. Pat. No. 5,025,424, to Rohrbaugh, relates to sensing of shockwaves. U.S. Pat. No. 5,228,854, to Eldridge, relates to a pure simulation system. U.S. Pat. No. 5,359,920, to Muirhead, relates to detection of radio frequencies generated by impacts. U.S. Pat. No. 5,432,546, to Cargill, relates to a sensor attached to the projectile itself. Finally, U.S. Pat. No. 5,521,634, to McGary, relates to an algorithm for compressing image data in a target sensing system.

The present invention provides a scoring system capable of detecting and reporting delivery of a wide variety of ordinance in real time under daytime and nighttime conditions. Once calibrated, the system is straightforward to set up and use, including automatic selection of targets.

SUMMARY OF THE INVENTION (DISCLOSURE OF THE INVENTION)

The present invention is of a military range scoring apparatus comprising: a plurality of imagers capable of viewing a plurality of reference points and impact points for ordinance aimed at the reference points; a remote imager controller and a processor for processing and viewing data received from the imagers; and control information and data communicating devices for interchange between the imagers and the remote imager controller. In the preferred embodiment, the controller and processor compise a video monitor and the data comprise video images calibrated for angular displacement across a horizontal axis. A device to measure the calibrated angular displacement between the reference point and the impact point without a requirement for detailed survey data is preferably employed, as is a device for calculating the displacement (X and Y and/or azimuth and distance) between the reference point and the impact point. The data communicating devices may including microwave, radio, fiber optic line, and wire line. The controller preferably comprises a positioner used to aim an imager at a reference point by changing azimuth and elevation of the imager. A database of reference points and imager locations allows rapid and accurate calculation of impact points. The imagers are preferably sensitive to infrared radiation, and preferably are capable of sensing laser radiation used to target and guide smart weapons. The imagers may include flux gate compasses used to sense imager horizontal pointing angle, to allow accurate horizontal positioning and status information provided to the controller, as well as inclinometers used to sense imager vertical pointing angle, to allow accurate vertical positioning and status information provided to the controller. The controller preferably includes a computer storing imager pointing, setup, and calibration data for multiple reference points, and means for setting imager parameters including field of view, zoom, focus, sensitivity, and contrast. The system preferably employs a computer for automatically scoring proximities of impact points to reference points and a device causing the controller to direct imagers to point at a reference point, reading back calibration data from the imagers, and entering the calibration data into scoring calculations so that manual calibration is not required. The processor includes a video image digitizer and a digital signal processor for determining angular offsets and scoring an impact point from the digitized video image, which can detect multiple impacts and score impact points without user intervention, as well as storage and retrieval mechanisms for the digitized video images.

A primary object of the present invention is to provide a scoring system capable of detecting and accurately reporting delivery of a wide variety of ordinance.

Another object of the present invention is to provide a scoring system capable of functioning under both daytime and nighttime conditions.

A primary advantage of the present invention is that it provides for automatic selection of targets.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings:

FIG. 22 is intentionally omitted;

FIG. 29 is intentionally omitted; and

DESCRIPTION OF THE PREFERRED EMBODIMENTS (BEST MODES FOR CARRYING OUT THE INVENTION)

The present invention is of an ordinance scoring system employing, preferably, both optical and thermal imagers which can operate in multiple lighting conditions. The imagers sense visible light, near infrared, infrared, and military laser designators simultaneously with the ability to overlay each onto the others. The output of the sensor is a video-like presentation displaying different energy levels rather than light levels. By sensing the energy levels of each object in the field of view, the imager works as well in the absence of light as it does in visibly bright conditions. Accordingly, the sensor will operate under all day and night ambient conditions and can detect the impact of every type of ordinance now in use as well as a laser spot designator illuminating targets for smart weapons. The sensor can also track the "fly in" path of many weapons that are adequately heated by air resistance during delivery.

The present invention also incorporates a control system which, when calibrated, will automatically position the imager on any selected target with high azimuth and inclination accuracy, such as of 0.05% error or less. The miss distance between the target and the weapon impact can then be calculated using multiple sensor azimuth triangulation or single sensor azimuth and inclination differences.

The operator interfaces to the scoring system through a computer, preferably an IBM-PC compatible system running a Windows (trademark of Microsoft Corporation) operating system. During normal operations, scoring ordinance and repositioning the system to different targets is accomplished by a simple series of two or three clicks of the mouse, trackball, touch screen, or like input device.

The video from the sensor or sensors is digitized and displayed on the same computer screen used to control the system's operation and to score the weapon. The video can be frozen at the point of ordinance impact to allow very accurate cursor positioning and scoring. The digitized video can be saved and retrieved on a frame-by-frame basis and re-processed, if required. The use of digital signal processing on the digitized video facilitates the implementation of automated scoring methods. A fully automated version of the invention senses the moment of impact and scores its location with no operator intervention.

Figure 1:
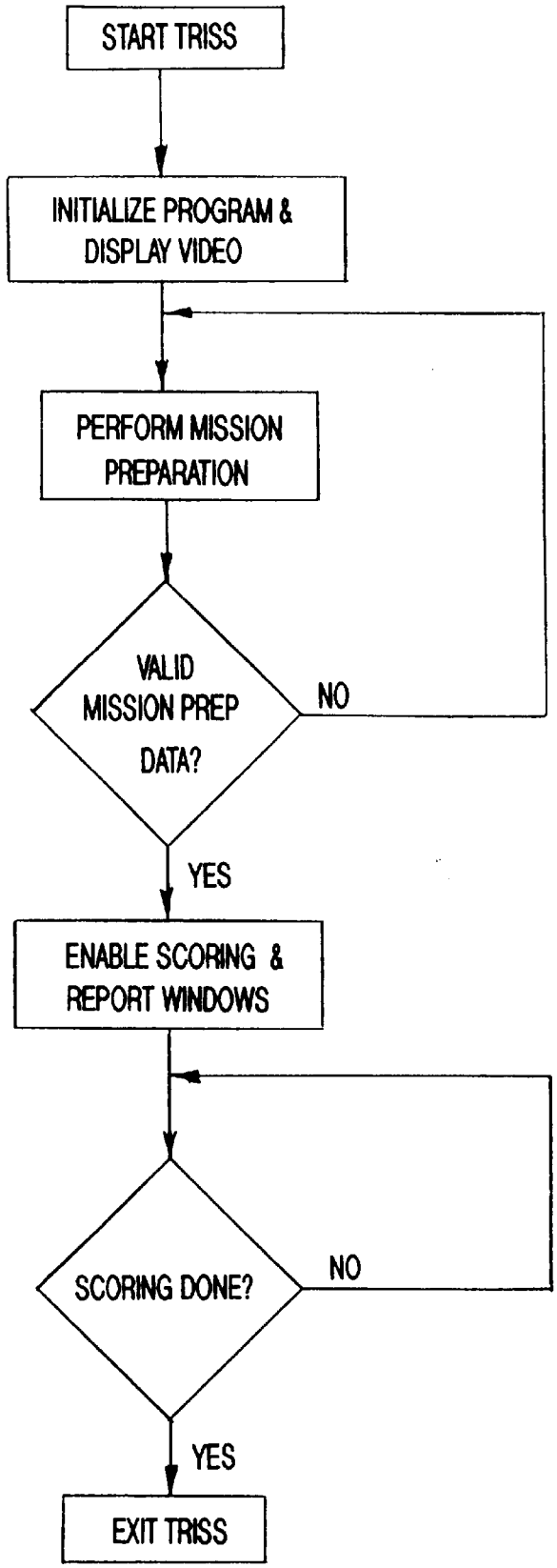
FIG. 1 is a flowchart of the top-level functionality provided by the preferred scoring system of the invention.
Figure 2:
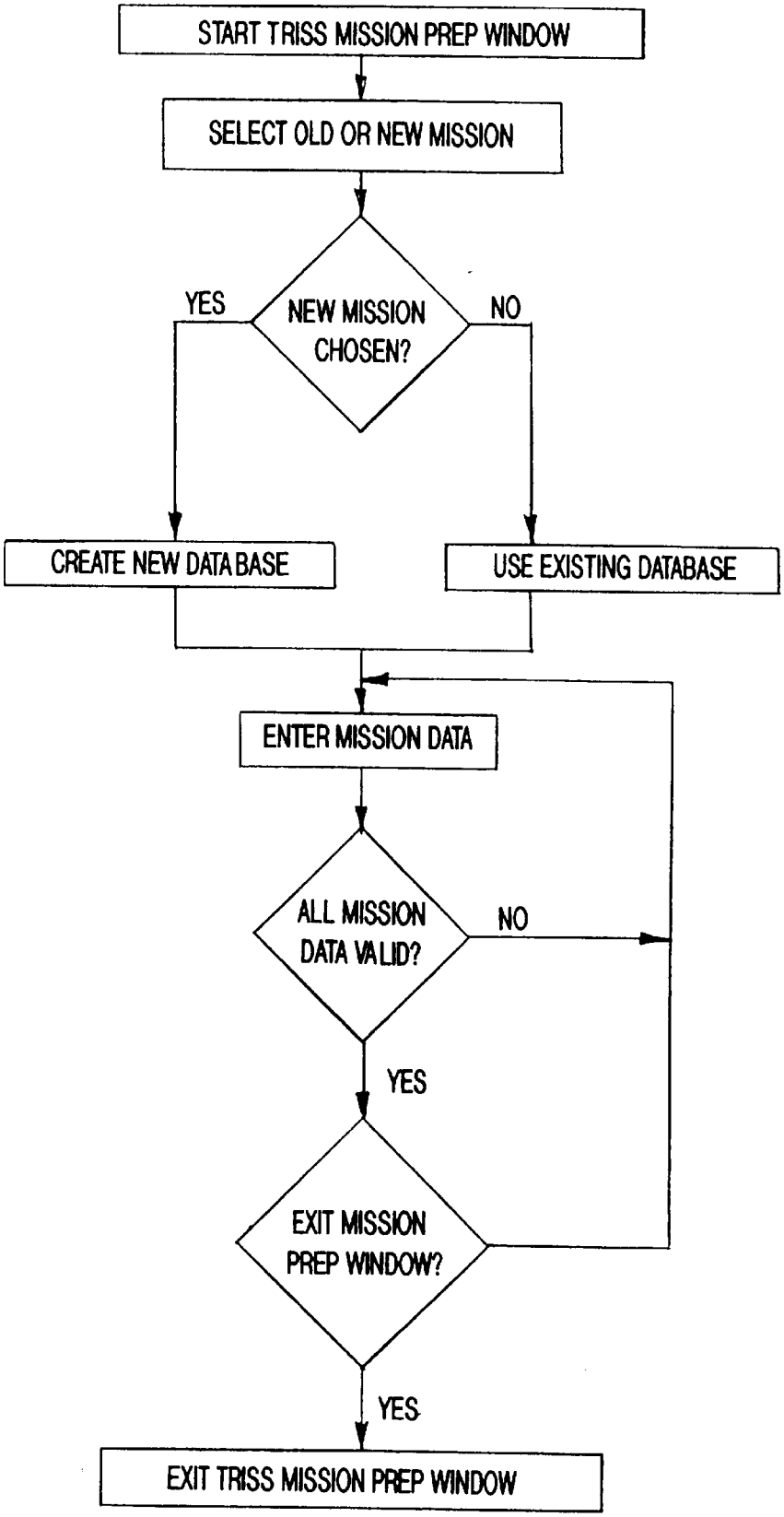
FIG. 2 is a flowchart of the mission preparation function of the scoring system.
Figure 3:
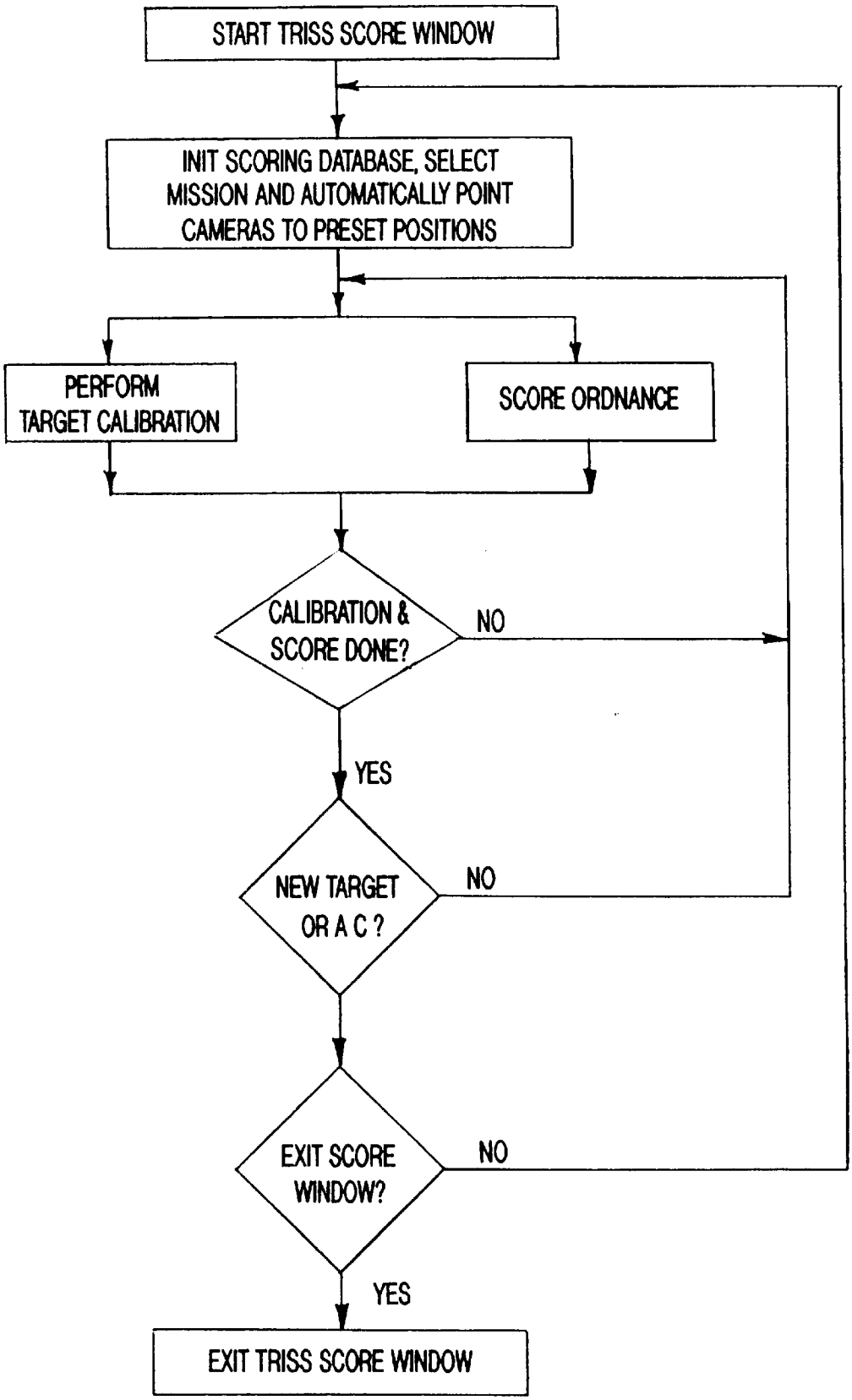
FIG. 3 is a flowchart of the scoring and report function.
Figure 4:
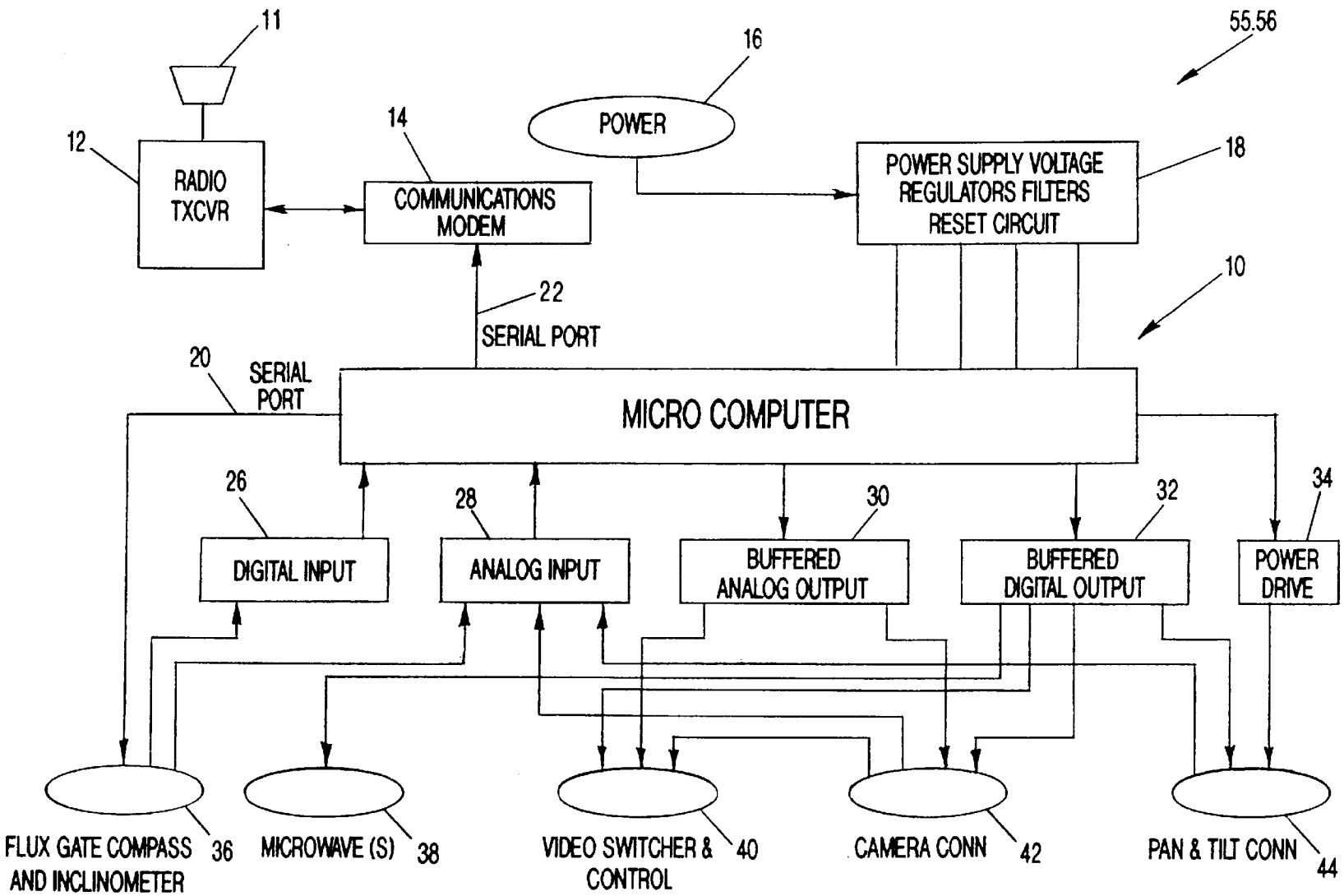
FIG. 4 is a schematic of the preferred controller of the invention.
Figure 5:
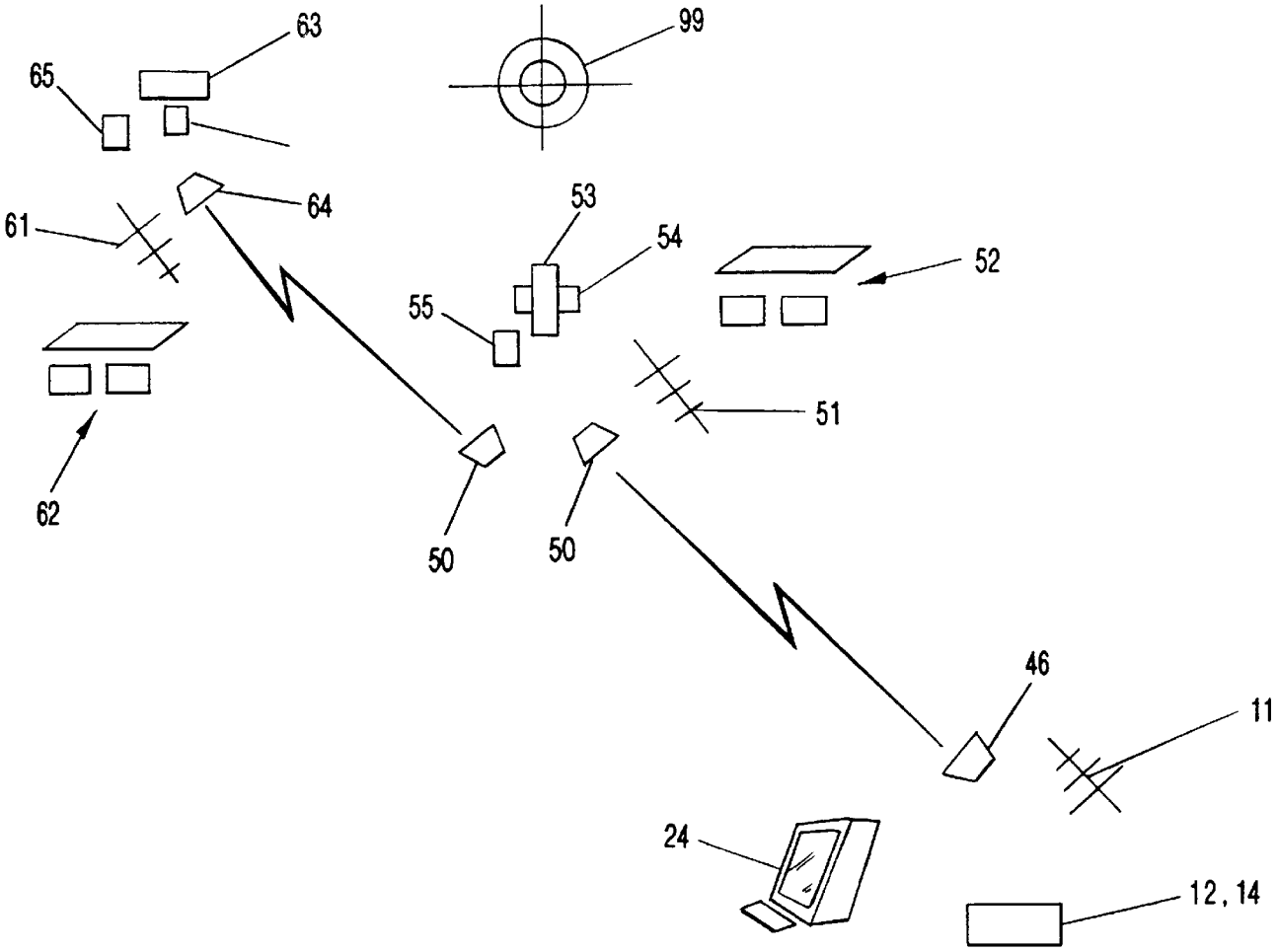
FIG. 5 is a schematic of an exemplary scoring system deployed and in use.

Referring to FIGS. 1–3, these provide flowcharts of the high level logic of the scoring and control computer 24 of the invention, which is shown in FIG. 5. The preferred controller, diagrammed on FIG. 4, comprises microcomputer 10, supplied by power 16 and power supply voltage regulators, filters, and reset circuitry 18. Via serial port 22, the microcomputer communicates with modem 14 to provide two-way communication with the scoring and control computer via radio transceiver 12 and antenna 11. Serial port 20 provides communication to flux gate compass and inclinometer 36, which provides both digital 26 and analog 28 inputs back to the microcomputer. Communication with microwave units 38, video switcher and control 40, imager control 42, and pan and tilt control 44 is provided via analog input 28, buffered analog input 30, buffered digital output 32, and power driver 34.

FIG. 5 illustrates a typical system of the invention. Scoring and control computer 24 receives via microwave 46 and communicates via VHF radio antenna/modem 12,14,11 to, in this case, two imaging sites sending transmissions by microwave 50,60 and receiving communications by VHF antennas 51,61. Each site comprises a system controller 55,65, photoelectric and battery power supply means 52,62, a positioner 54,64, and an infrared imager 53,63. The imagers at the sites are controlled by the system controller on commands from the scoring and control computer as needed to observe target(s) 99.

Figure 6:
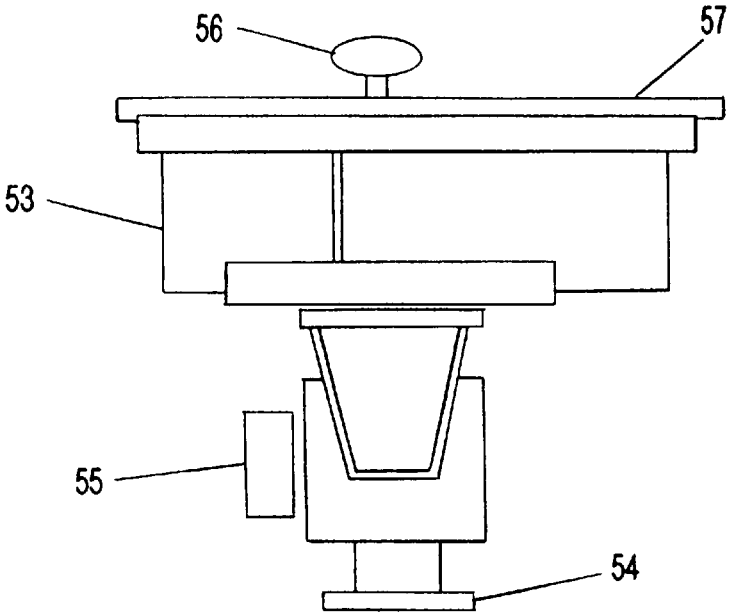
FIG. 6 is a schematic of the long range infrared imager preferred for use in the system.
Figure 7:
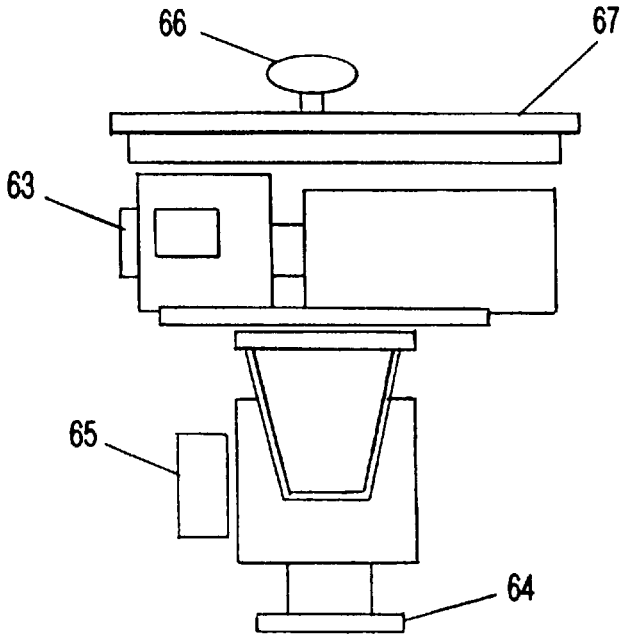
FIG. 7 is a schematic of the long range laser infrared imager preferred for use in the system.
Figure 8:
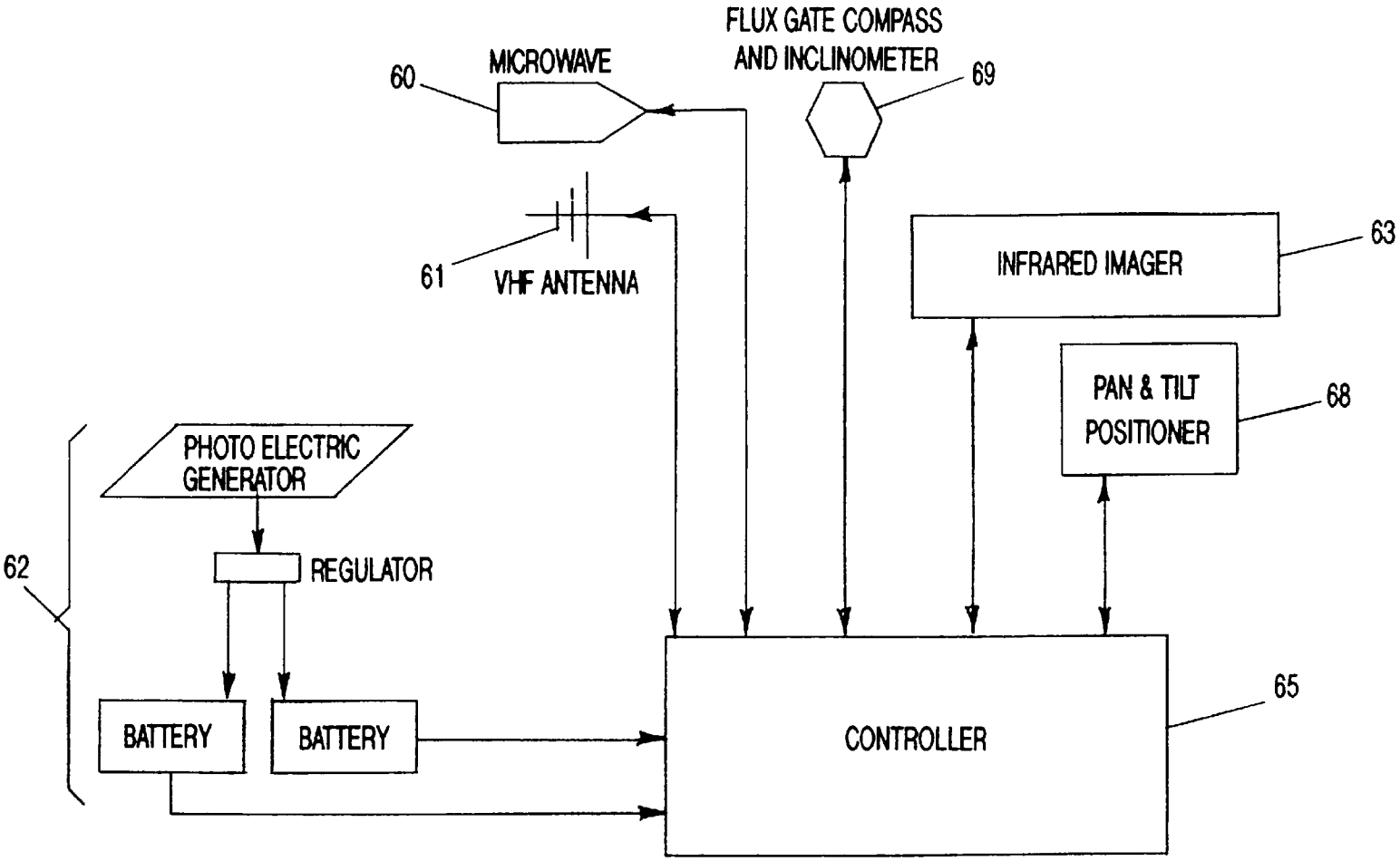
FIG. 8 is a schematic of the preferred imager site of the invention.
Figure 9:
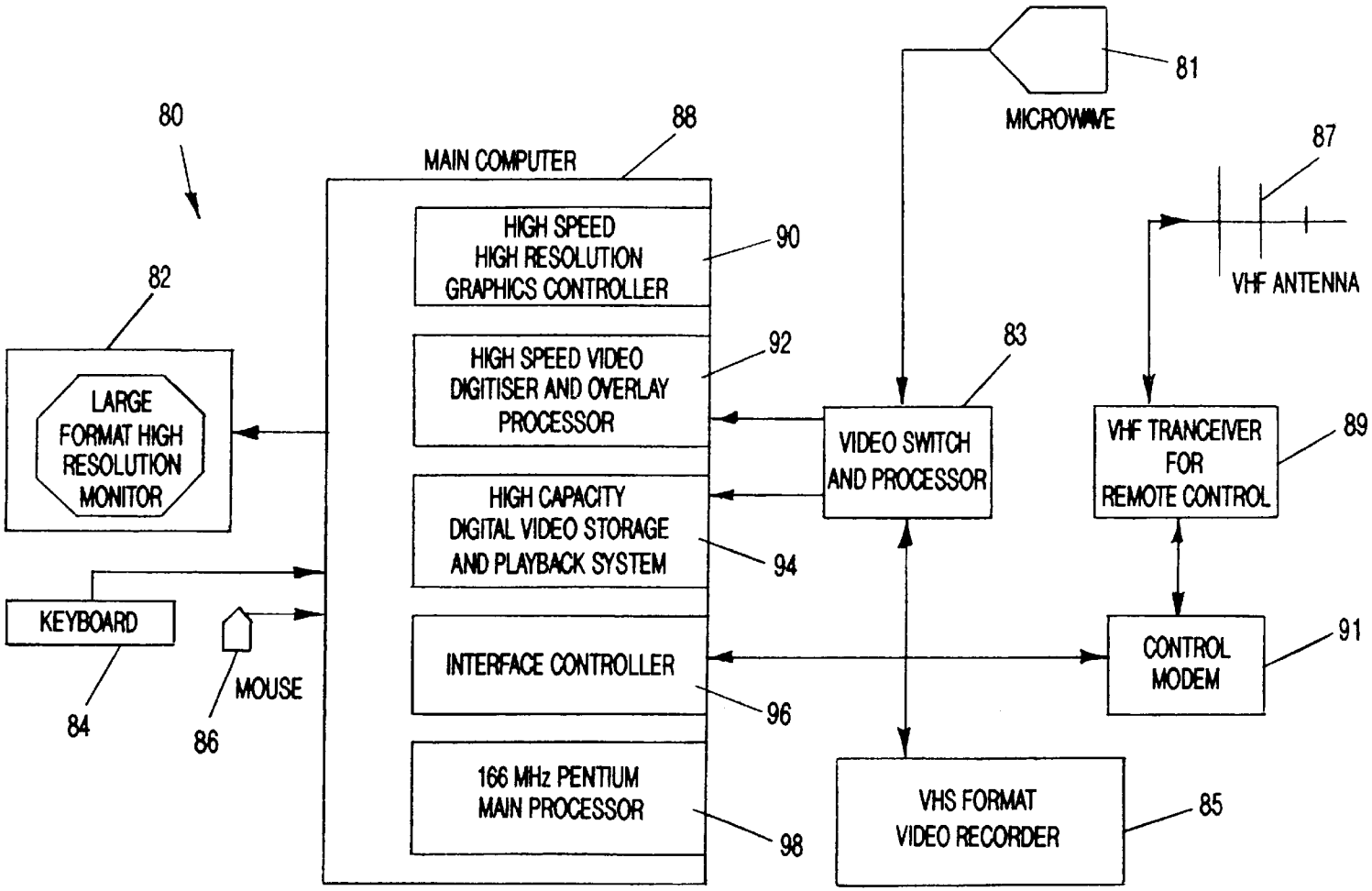
FIG. 9 is a schematic of the preferred scoring position of the invention.
Figure 10:
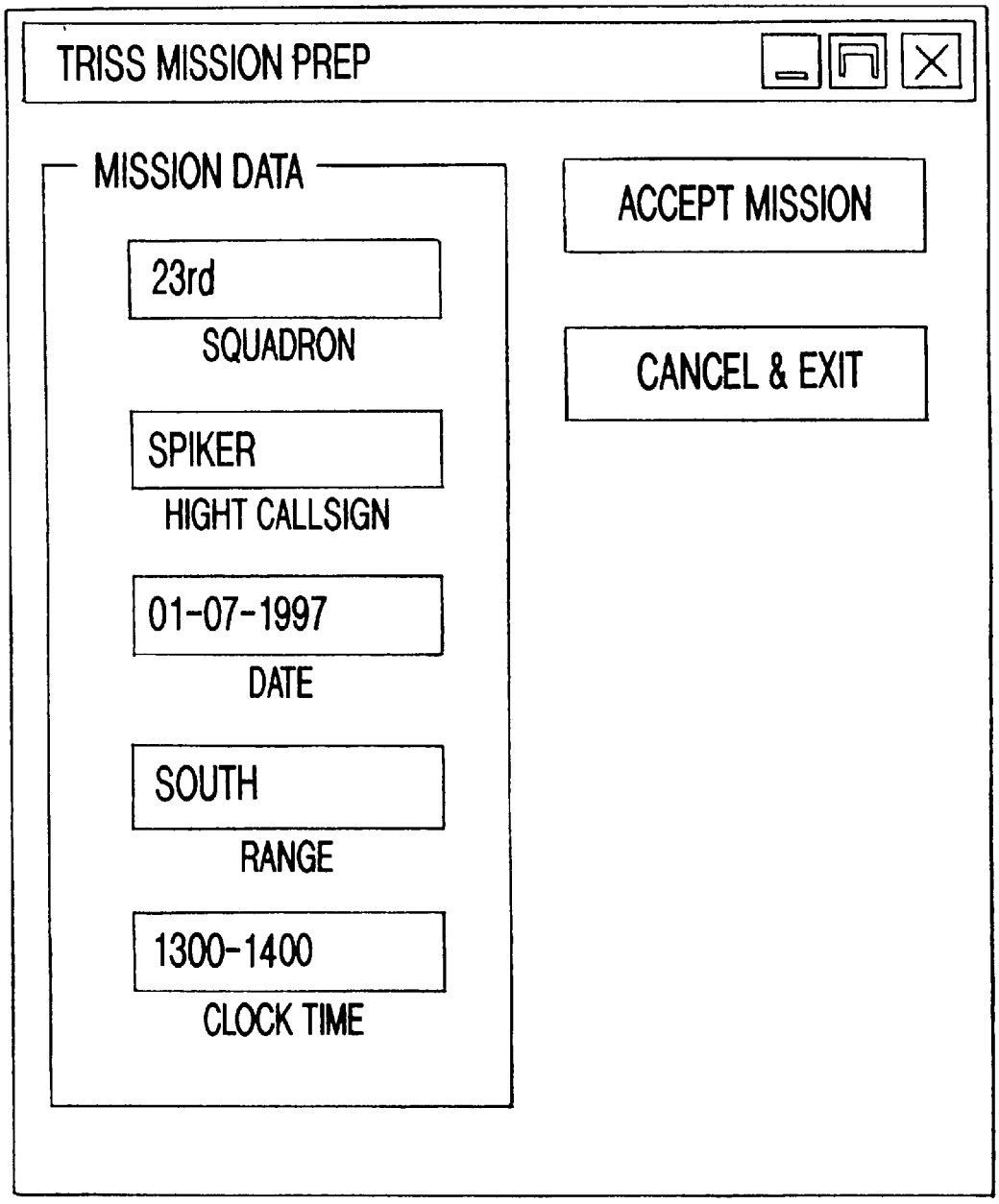
FIG. 10 is a window of the preferred software enabling input and selection of a mission.
Figure 11:
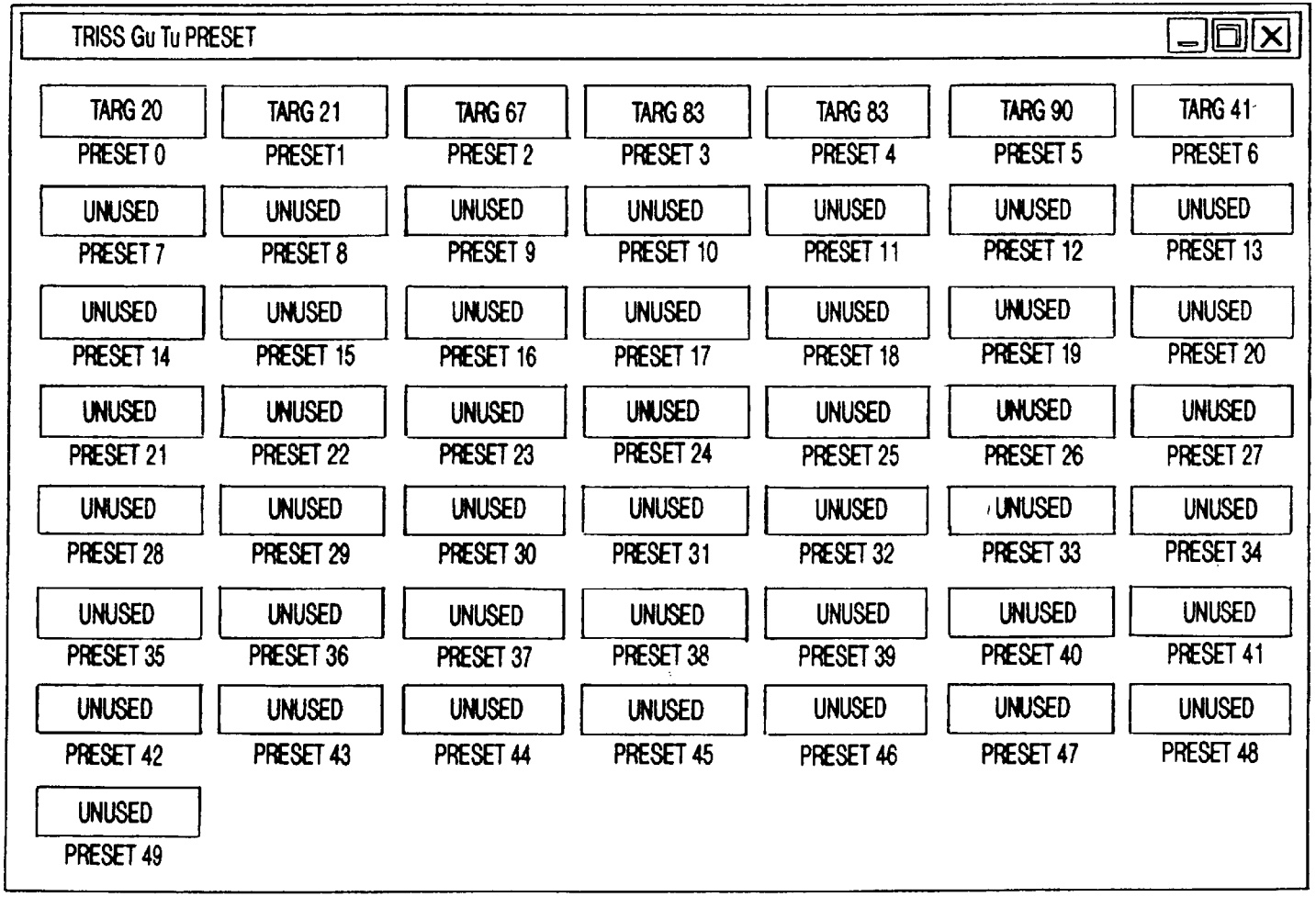
FIG. 11 is a window of the preferred software enabling setLinqs for targets.
Figure 12:
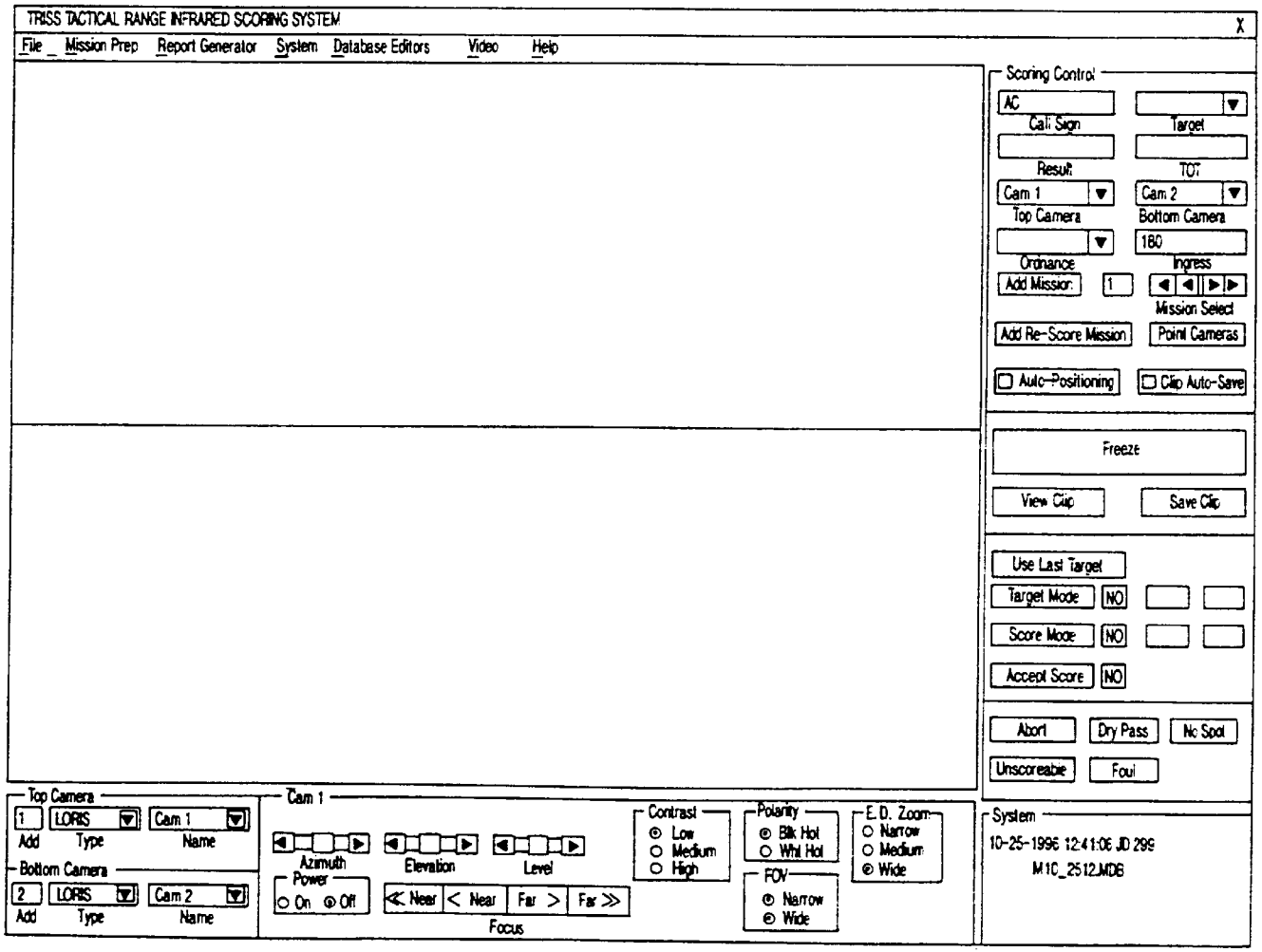
FIG. 12 is a window of the preferred software showing mission information and a real-time view of the target area while a mission is in progress, including functions to control imagers, select targets, and carry out scoring.
Figure 13:
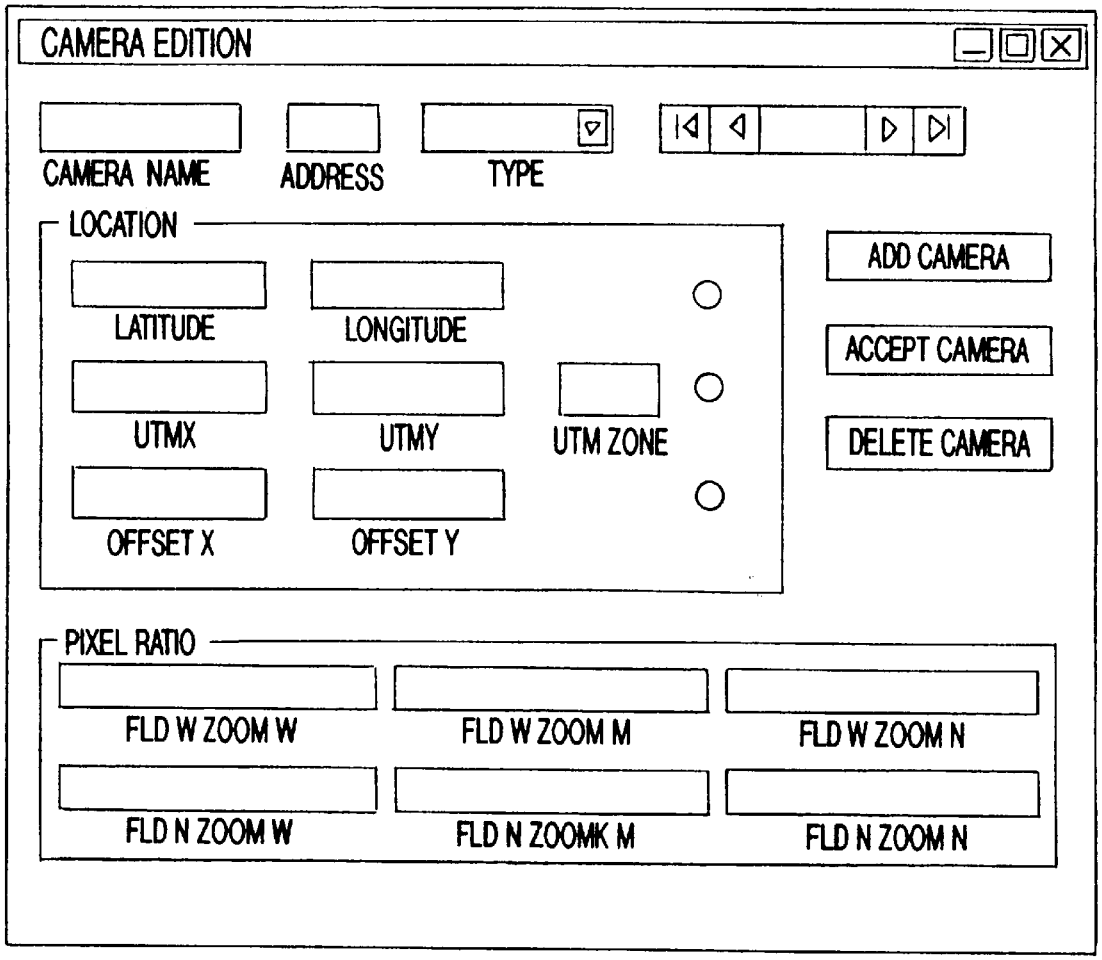
FIG. 13 is a window of the preferred software enabling setup of imager parameters.
Figure 14:
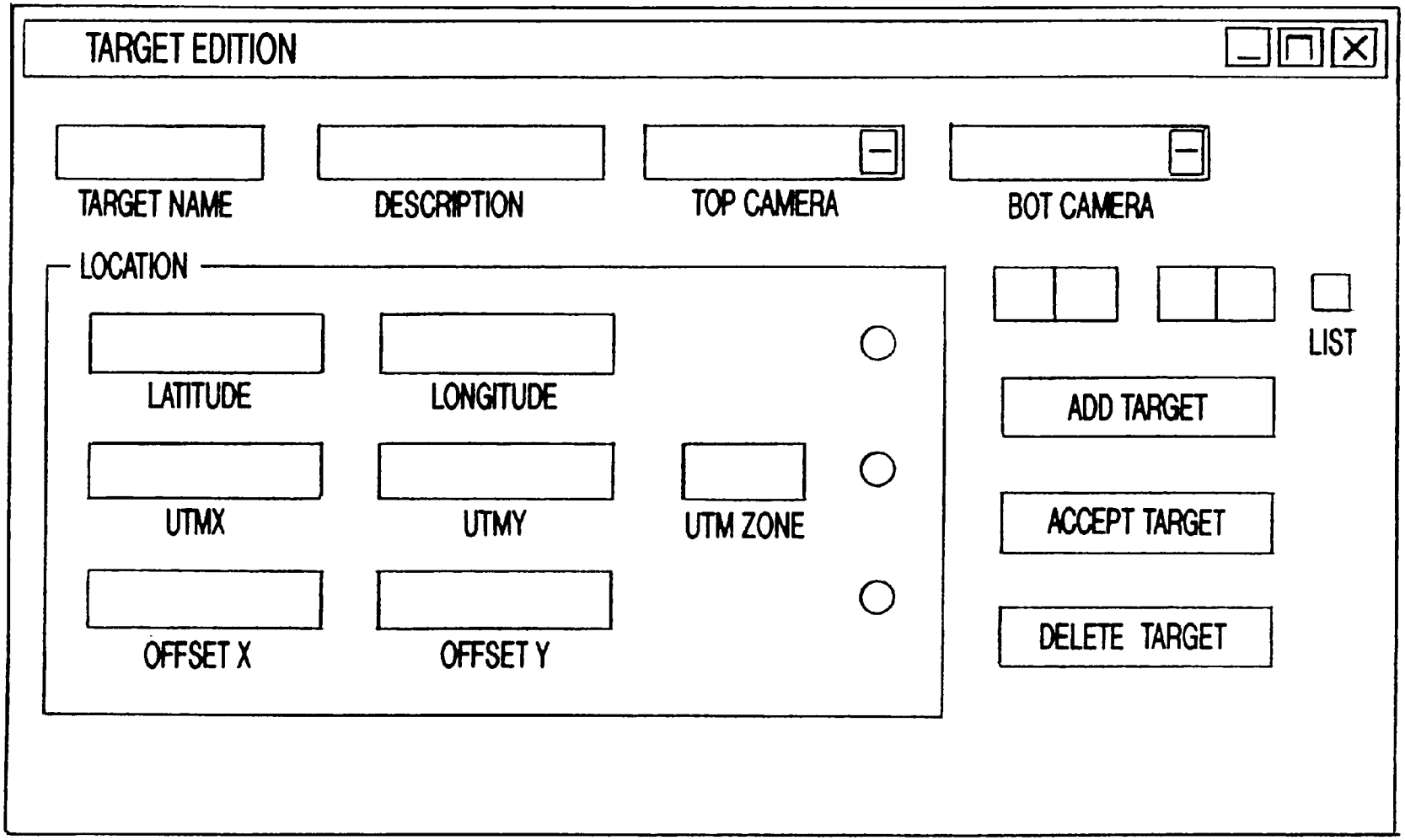
FIG. 14 is a window of the preferred software enabling setup of target parameters.
Figure 15:
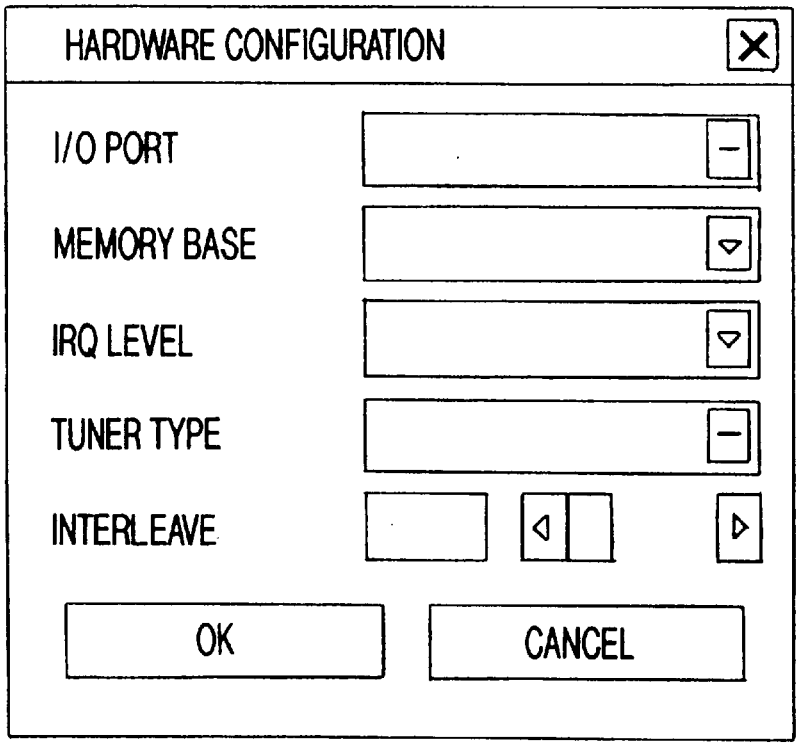
FIG. 15 is a window of the preferred software enabling setup of the communications interface between the computer and the video digitizer.
Figure 16:
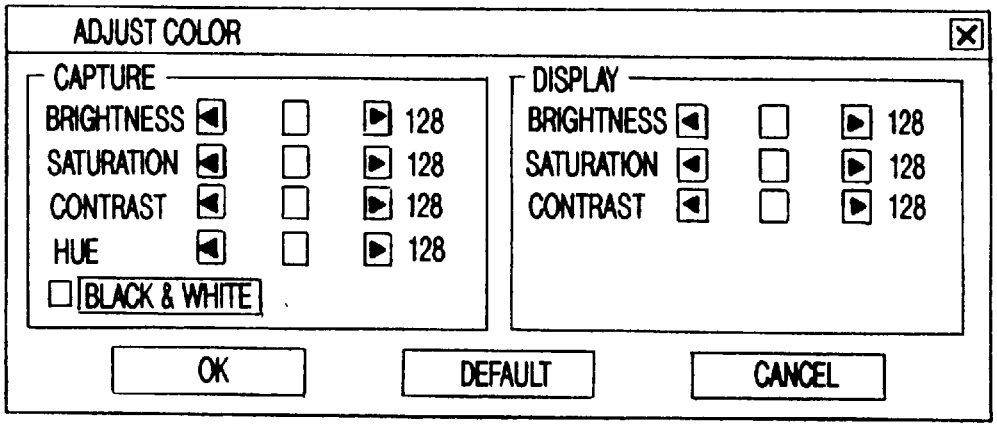
FIG. 16 is a window of the preferred software enabling control of display characteristics of the digitized video on the computer screen.
Figure 17:
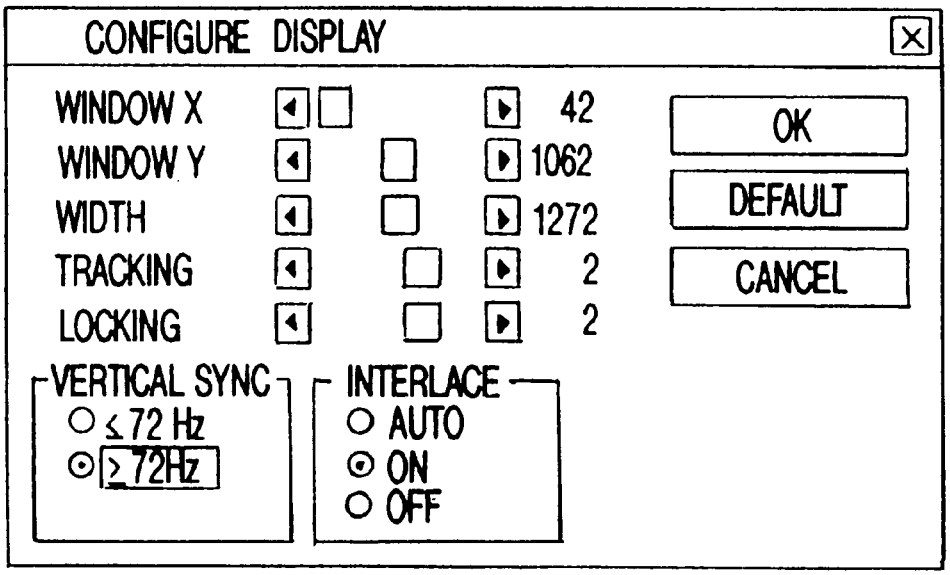
FIG. 17 is a window of the preferred software enabling control of position and refresh rate of digitized video on the computer screen.
Figure 18:
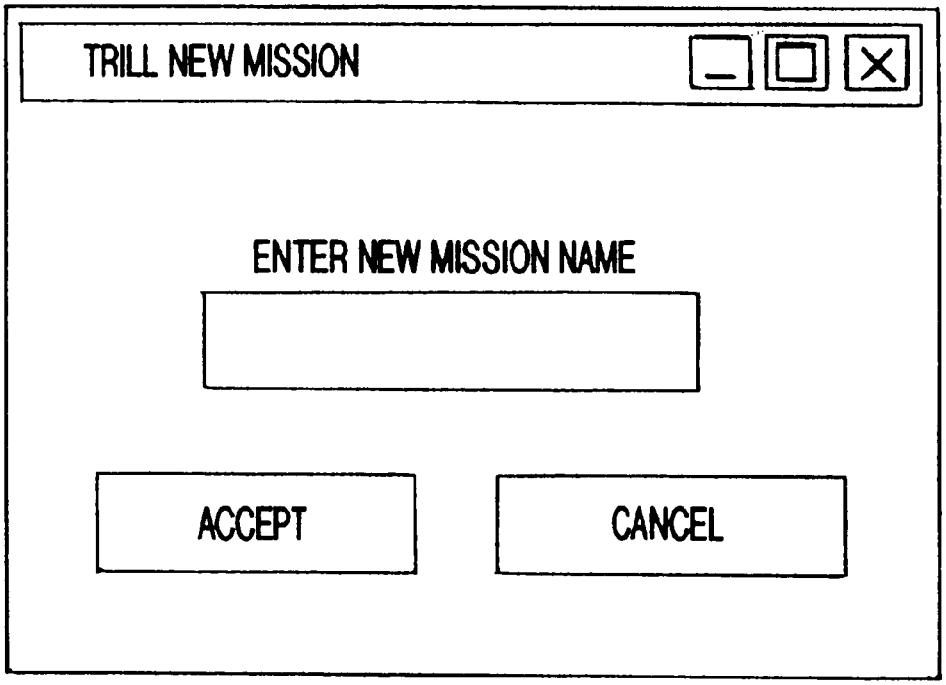
FIG. 18 is a window of the preferred software enabling mission creation and naming.
Figure 19:
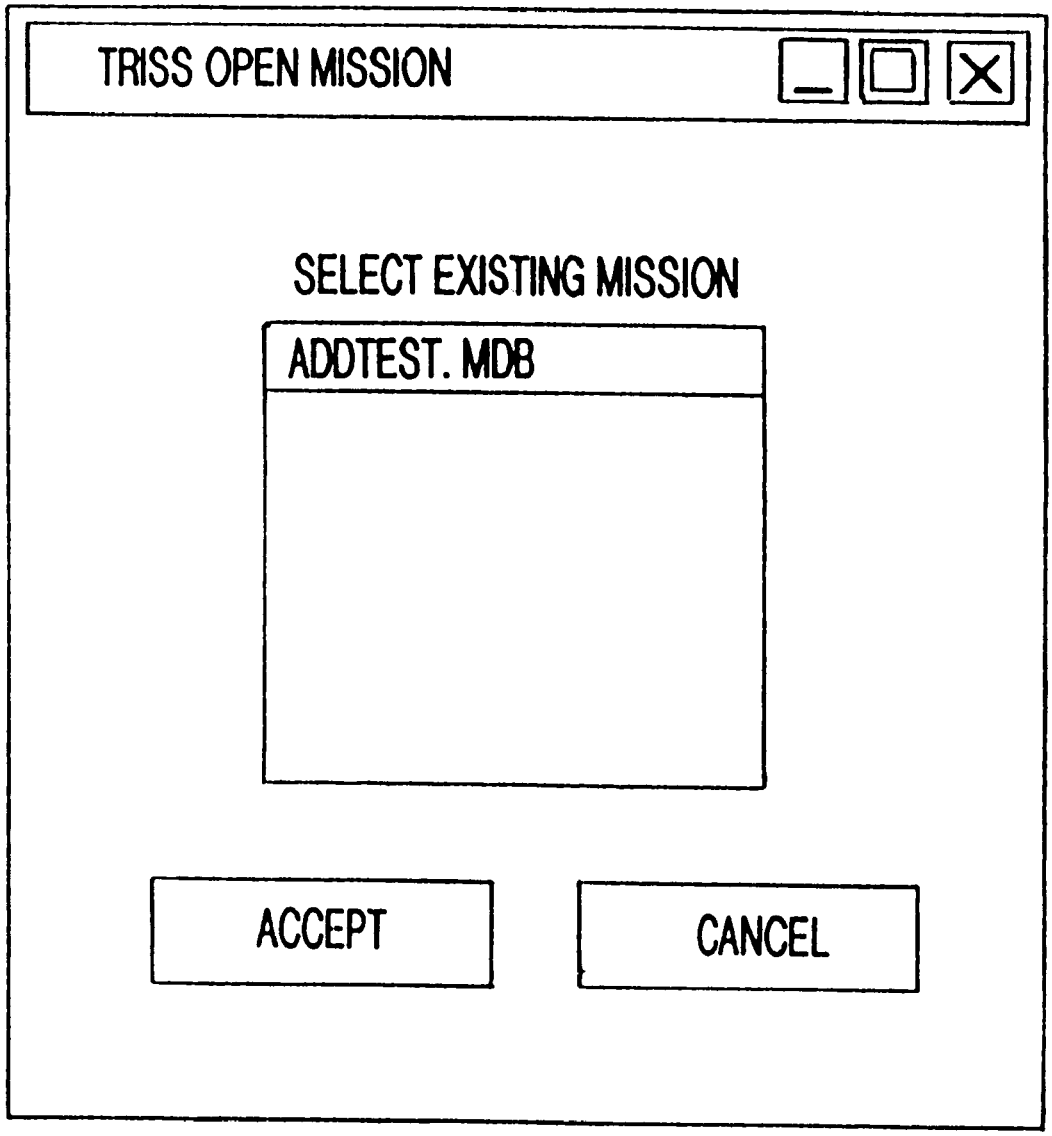
FIG. 19 is a window of the preferred software enabling mission selection from a panel of previously created missions.
Figure 20:
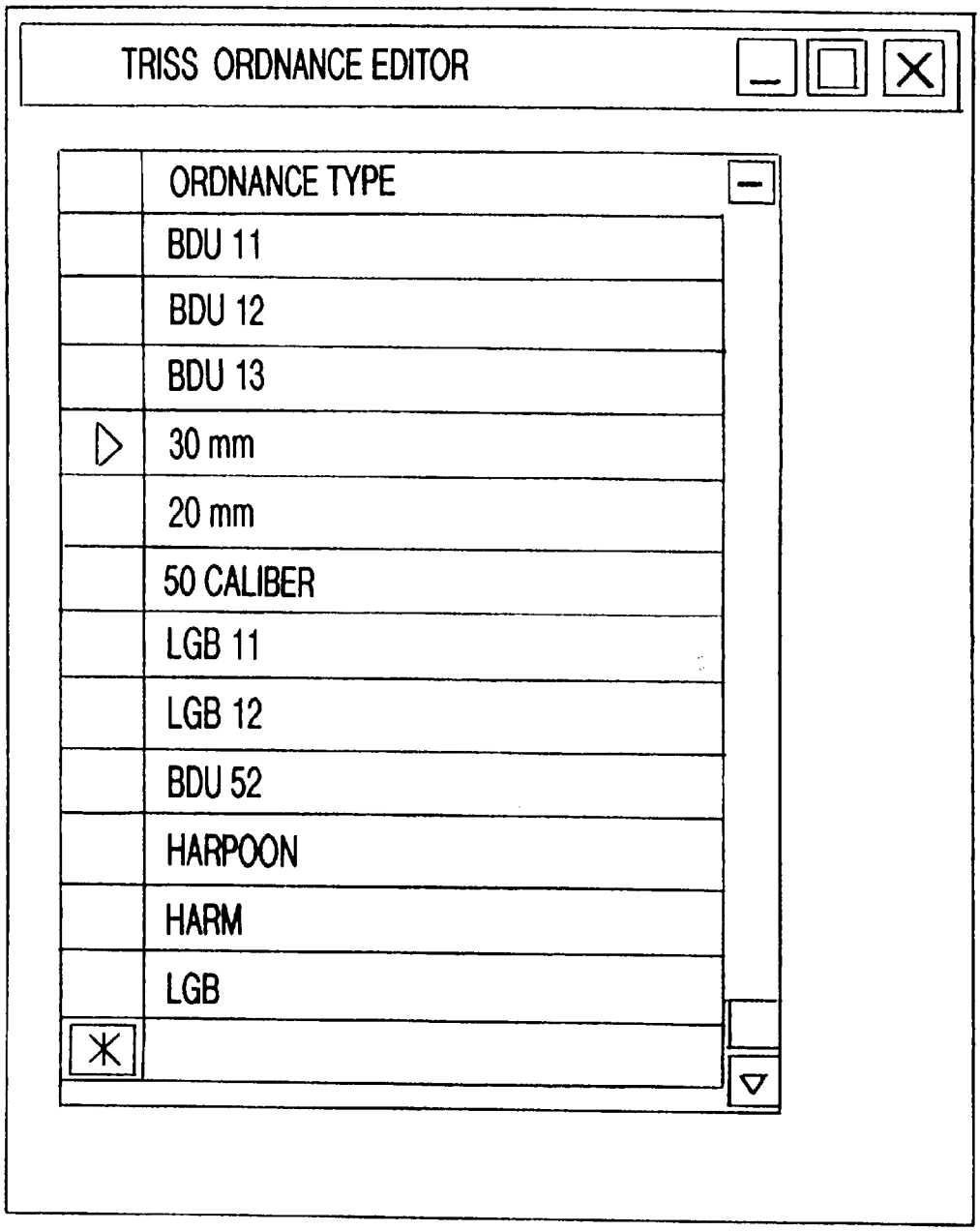
FIG. 20 is a window of the preferred software enabling selection of ordinance.
Figure 21:
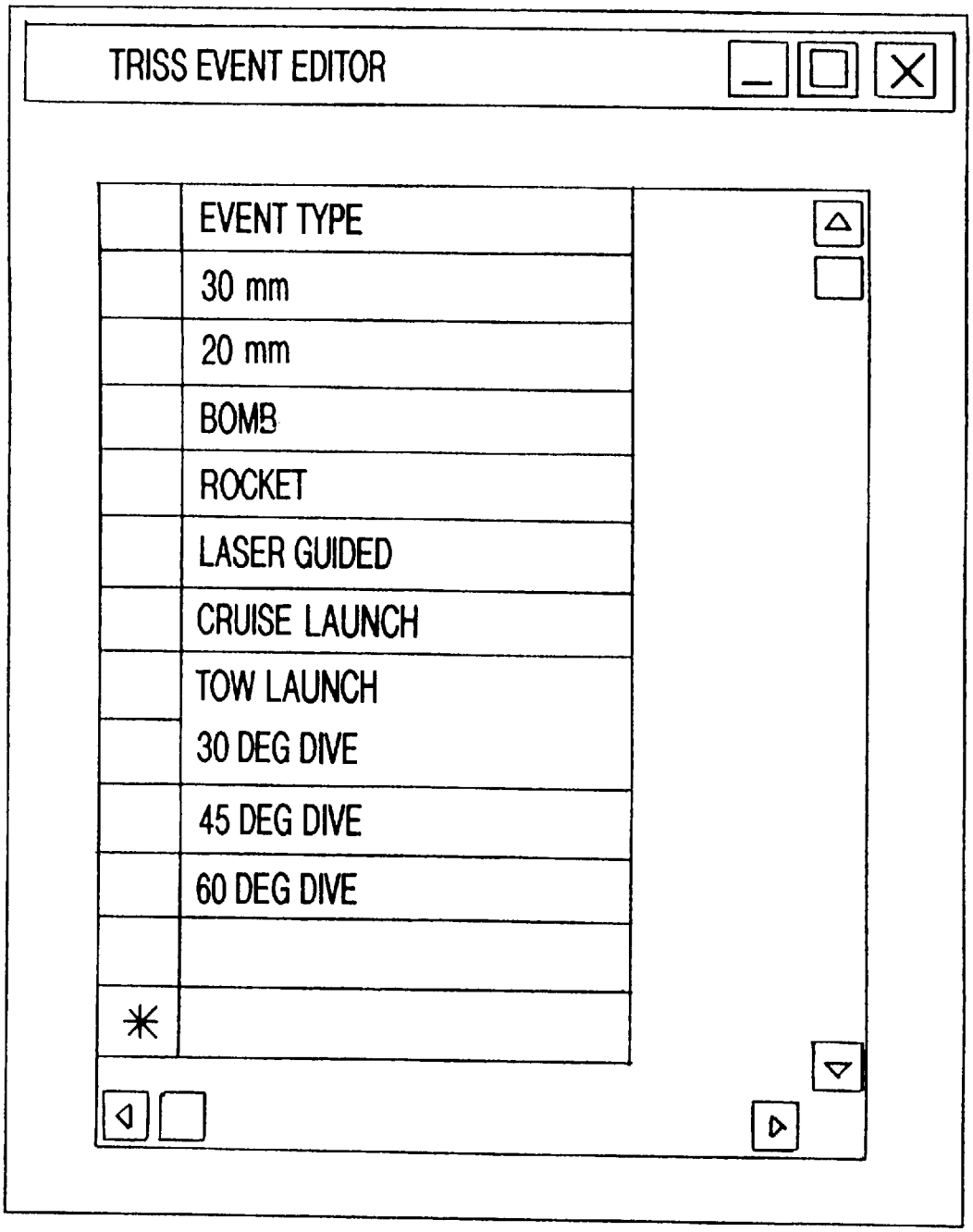
FIG. 21 is a window of the preferred software enabling selection of method of ordinance delivery.
Figure 23:
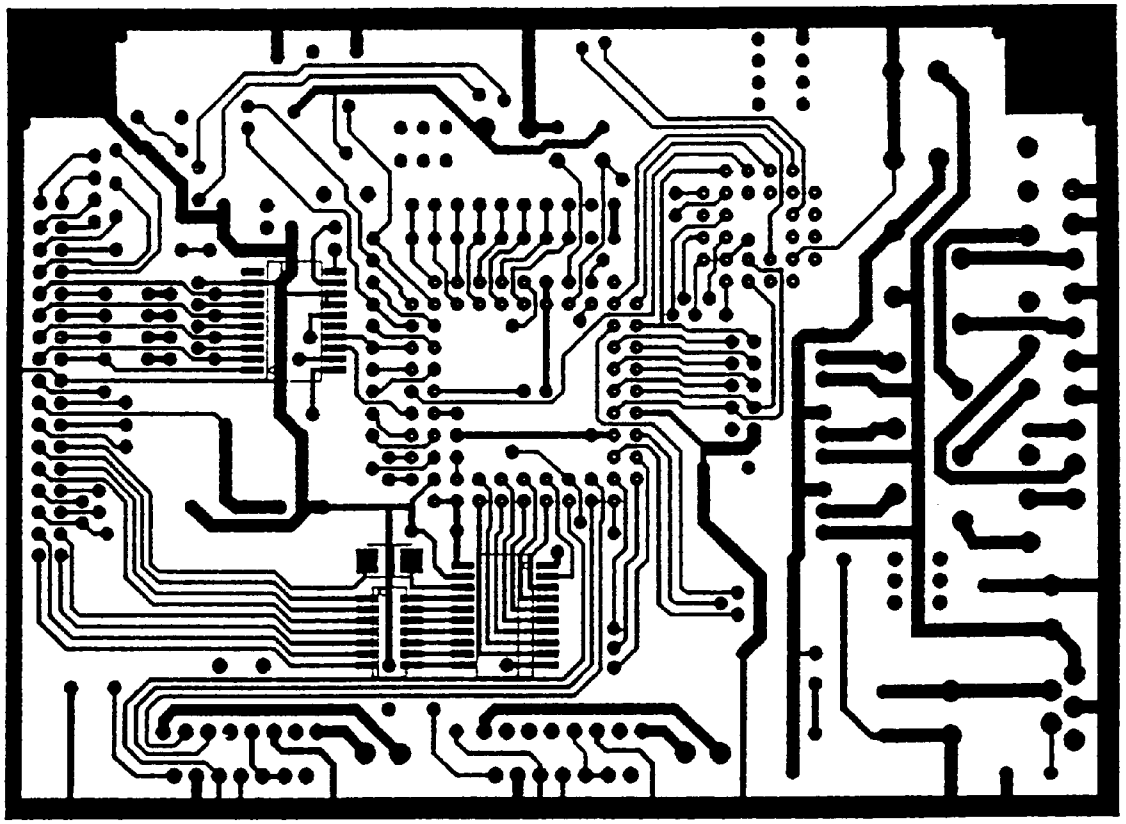
FIG. 23 is a trace view of the bottom of the preferred configuration of the remote controller mother board of the invention.
Figure 24:
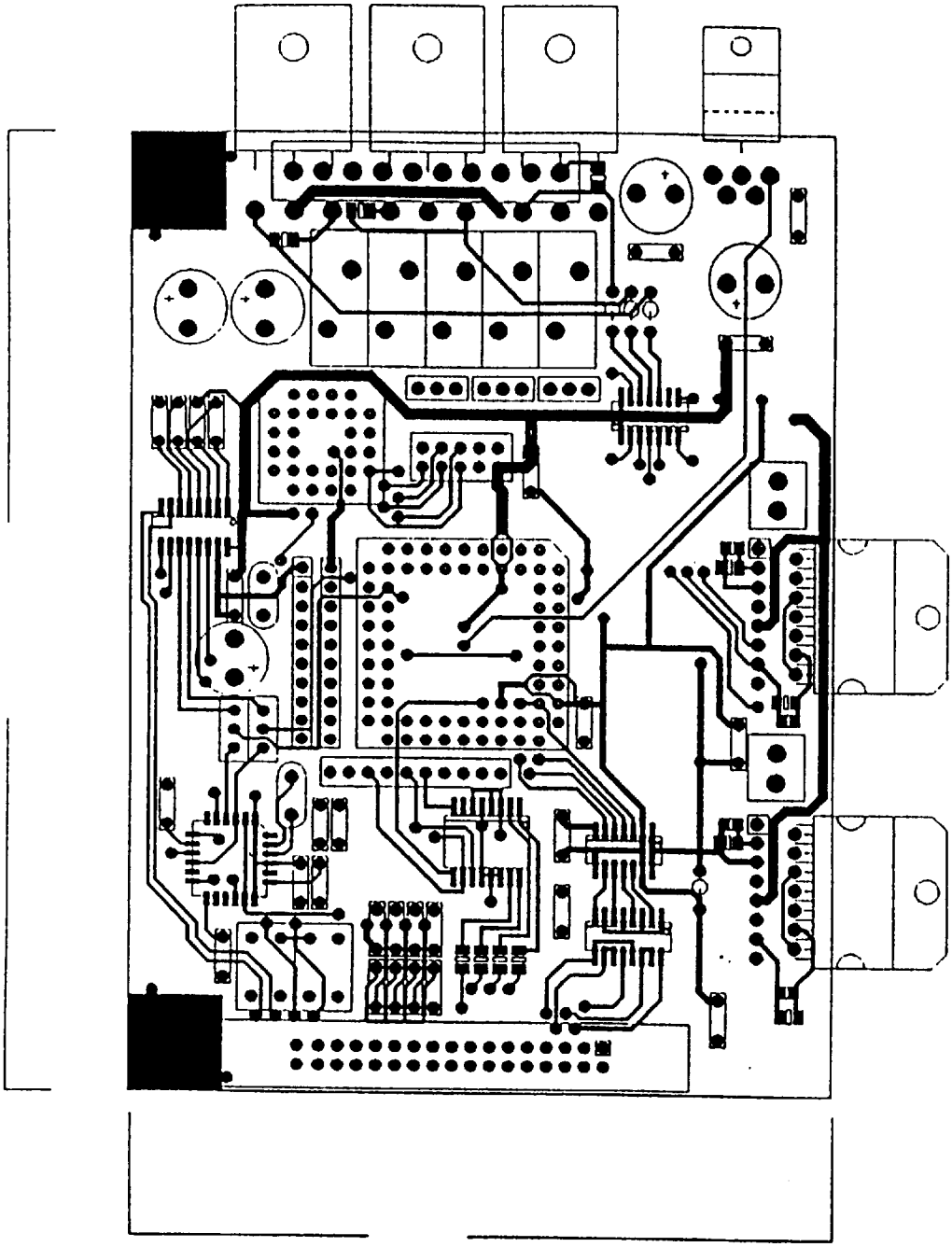
FIG. 24 is a trace view of the top of the preferred configuration of the remote controller mother board of the invention.
Figure 25:
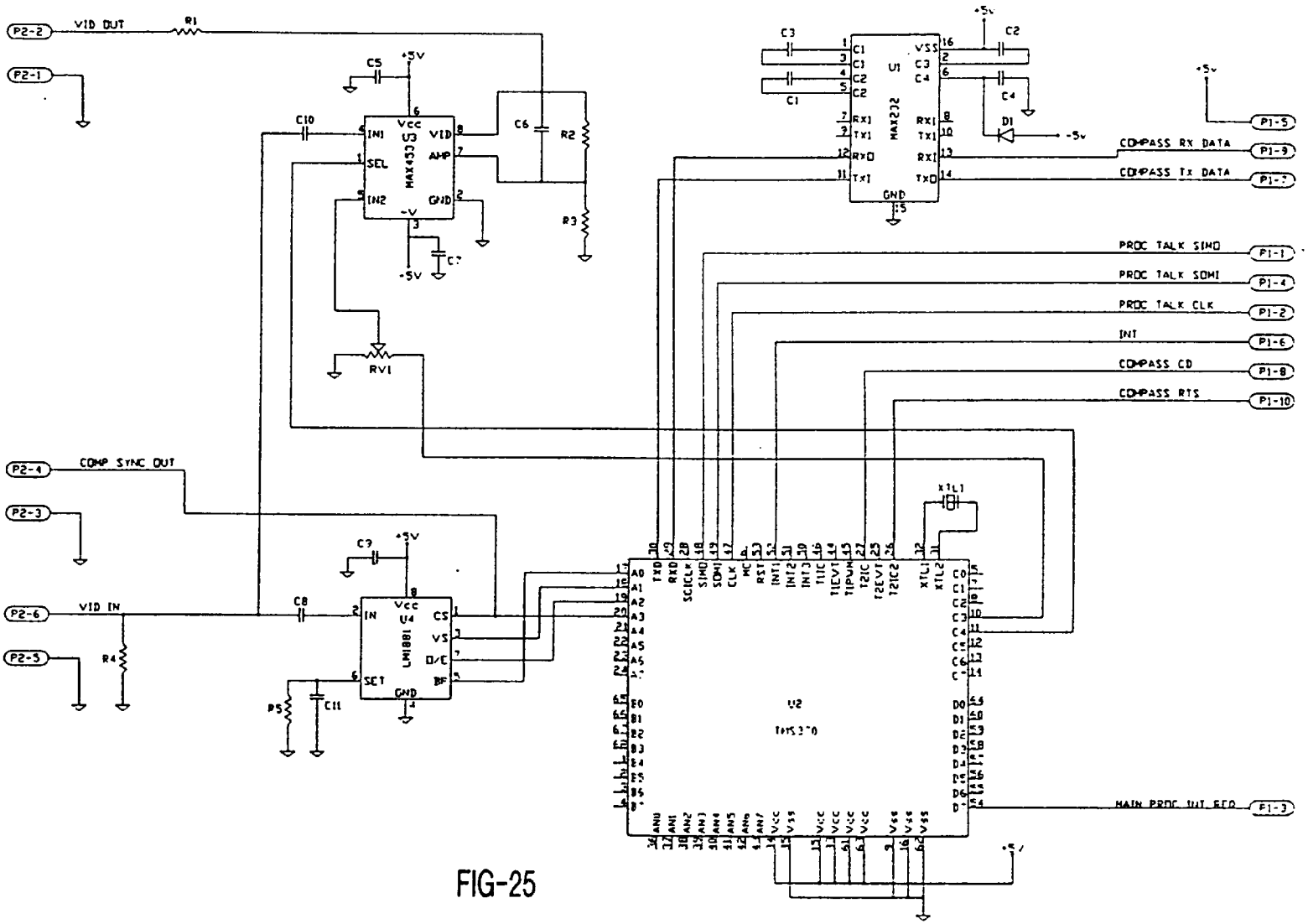
FIG. 25 is a schematic of the preferred compass controller and video data inserter of the invention.
Figure 26:
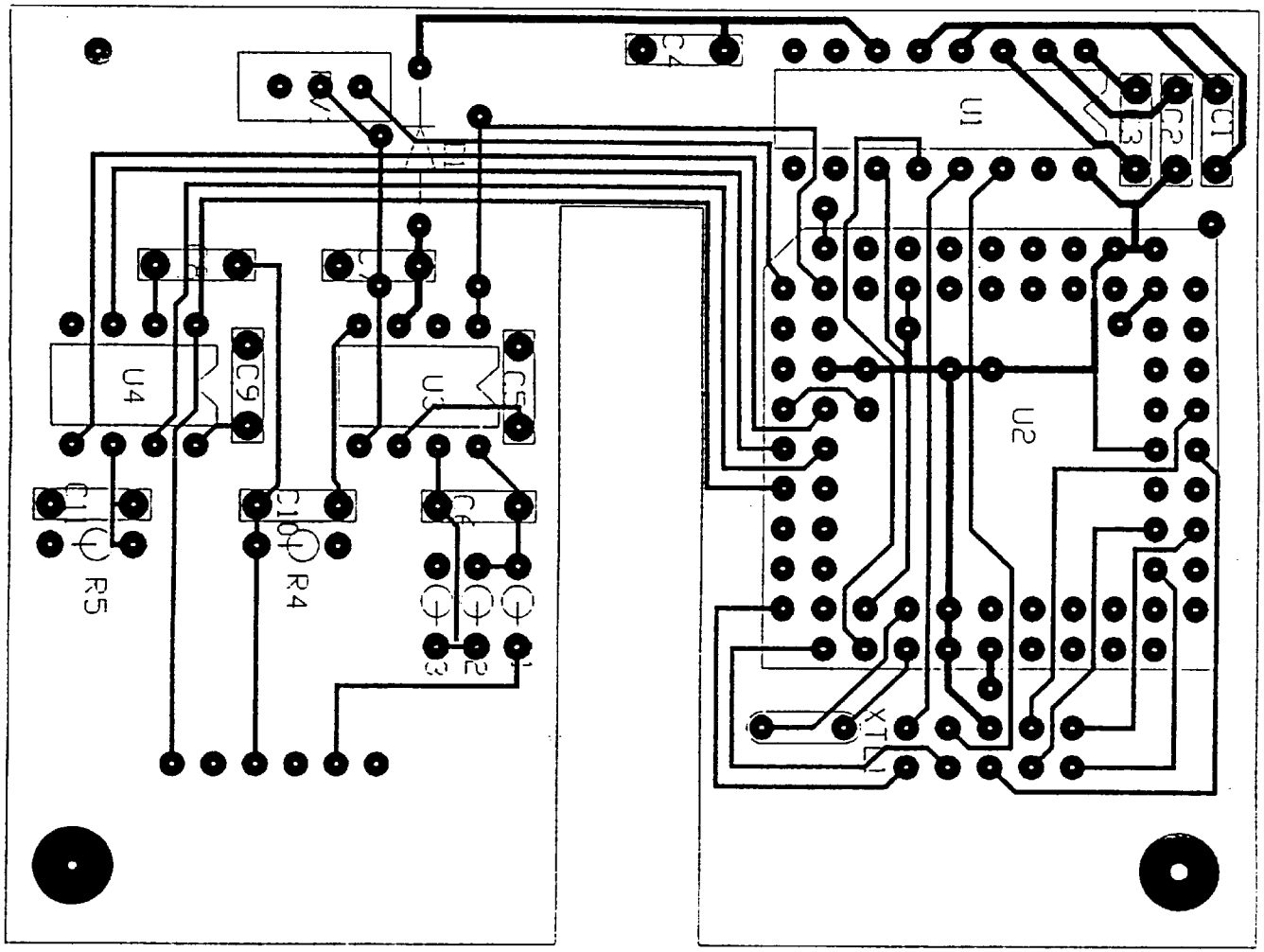
FIG. 26 is a bottom trace diagram for FIG. 25.
Figure 27:
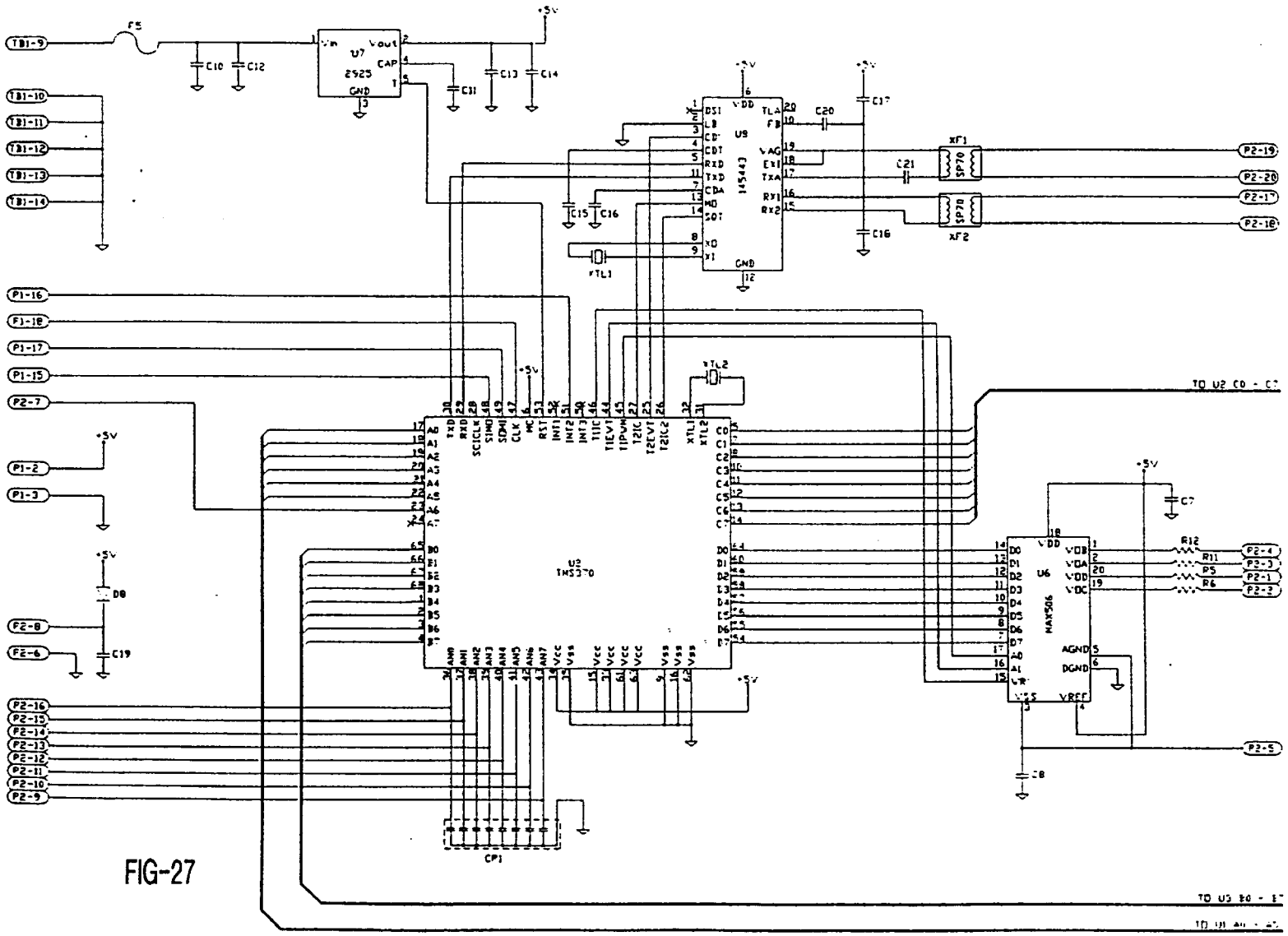
FIG. 27 is a schematic of the preferred mother board of the invention.
Figure 28:
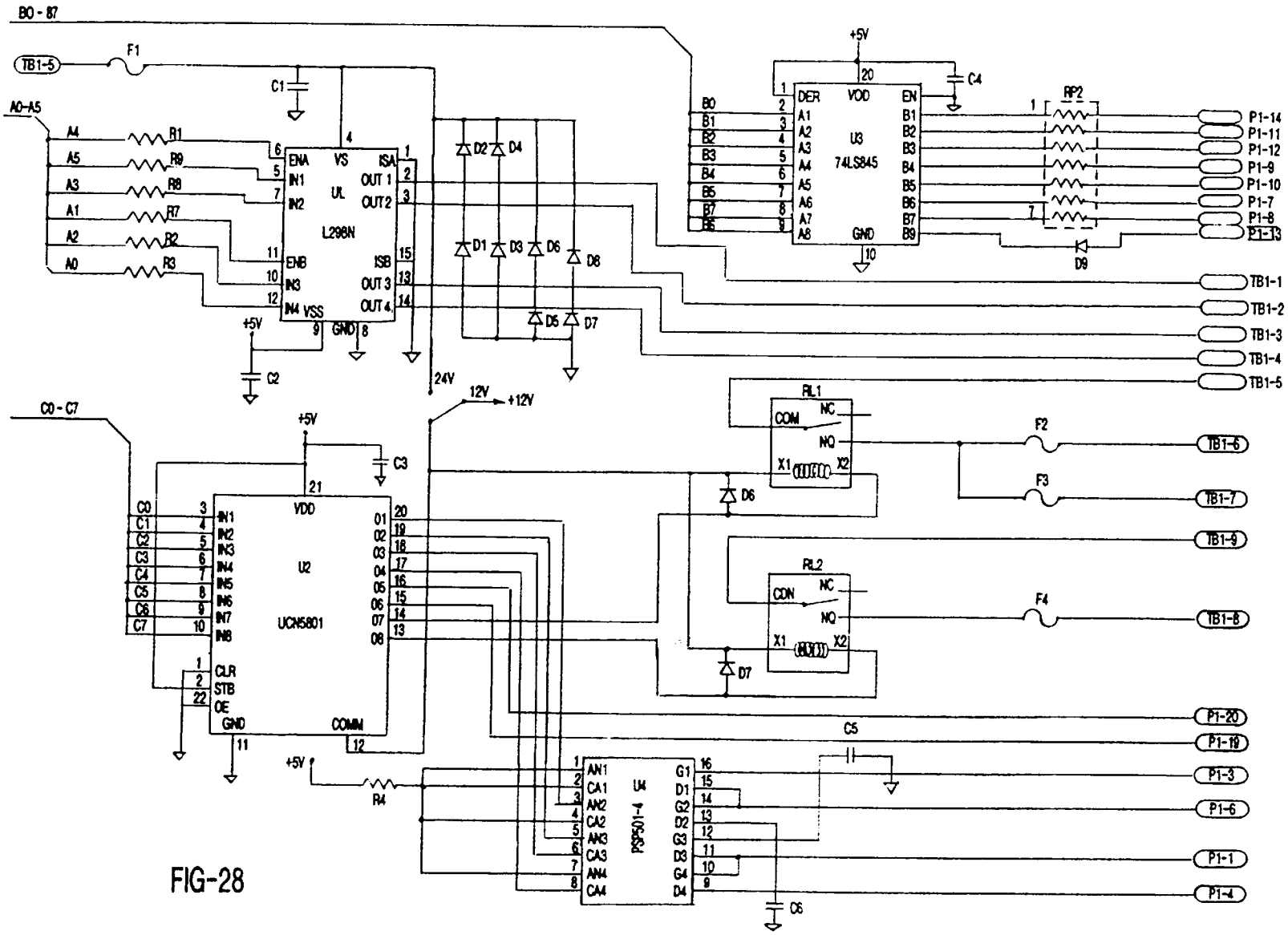
FIG. 28 is a continuation schematic from FIG. 27.
Figure 30:
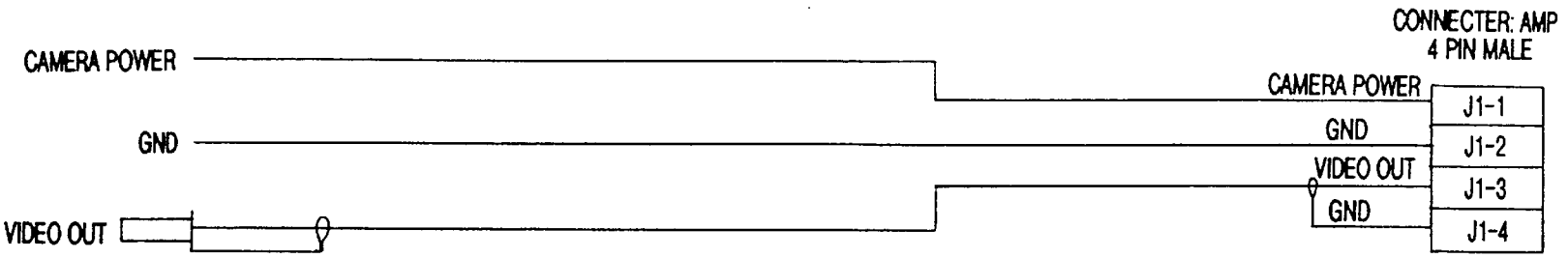
FIGS. 30–34 are schematics of the wiring harness connections for video, microwave, power, imager, and pan and tilt subsystems, respectively, that connect to the controller ports of FIG. 4.
Figure 31:
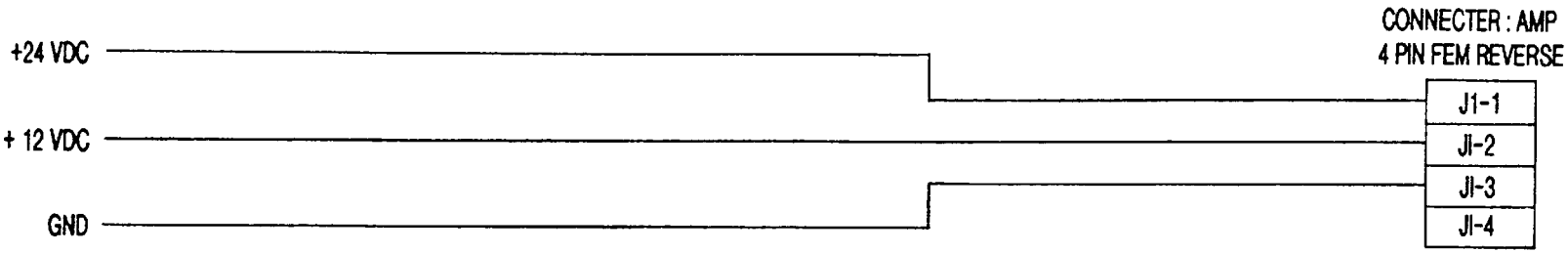
Figure 32:
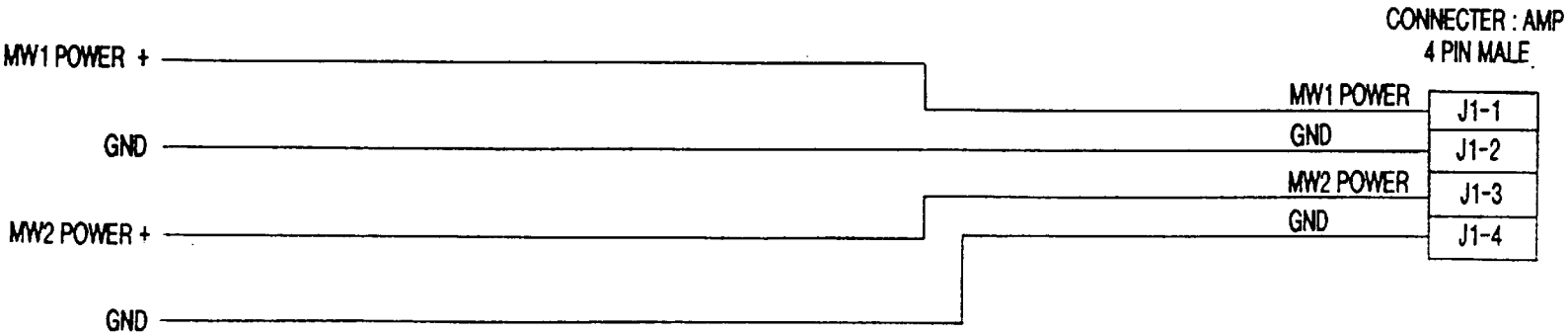
Figure 33:
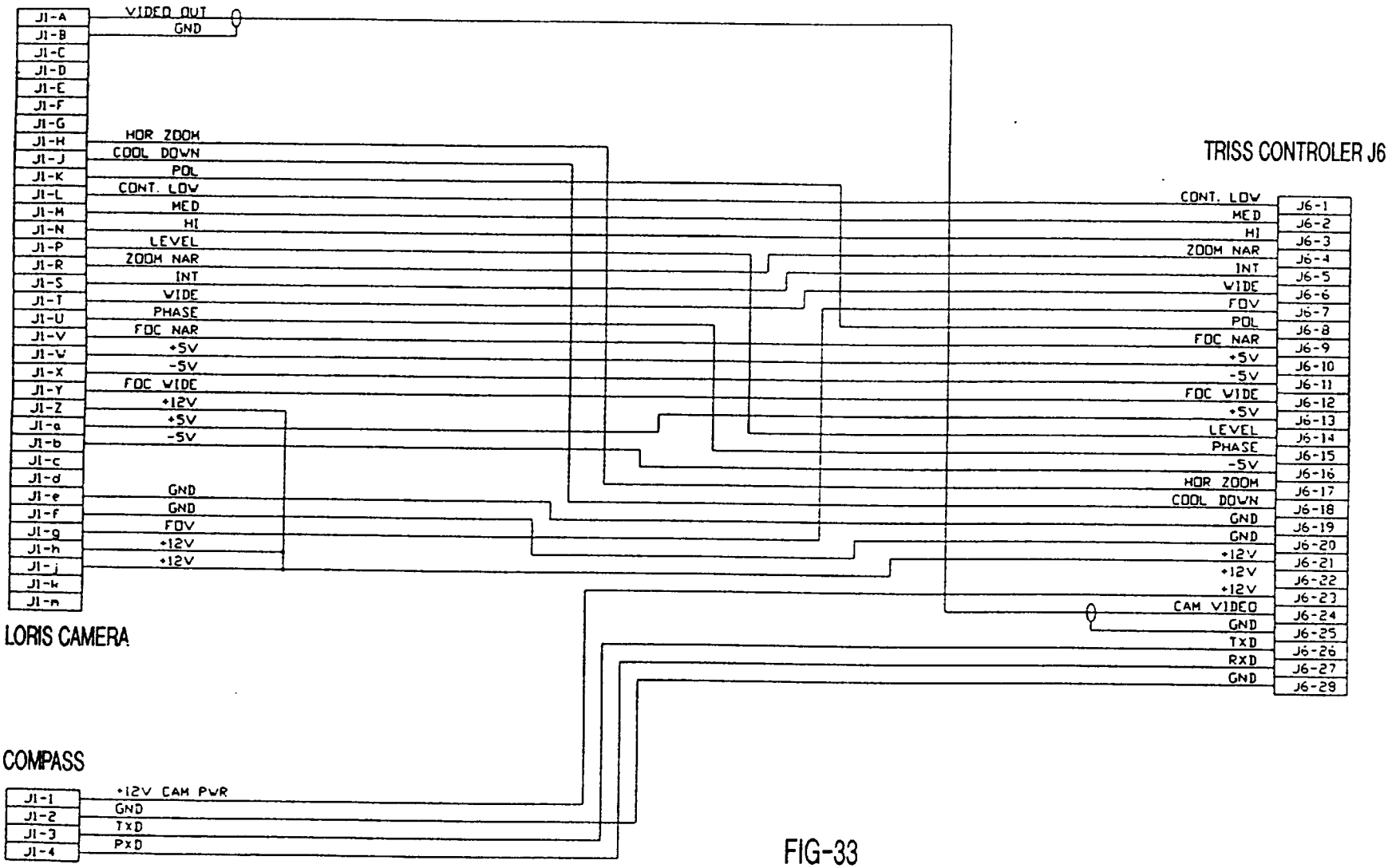
Figure 34:
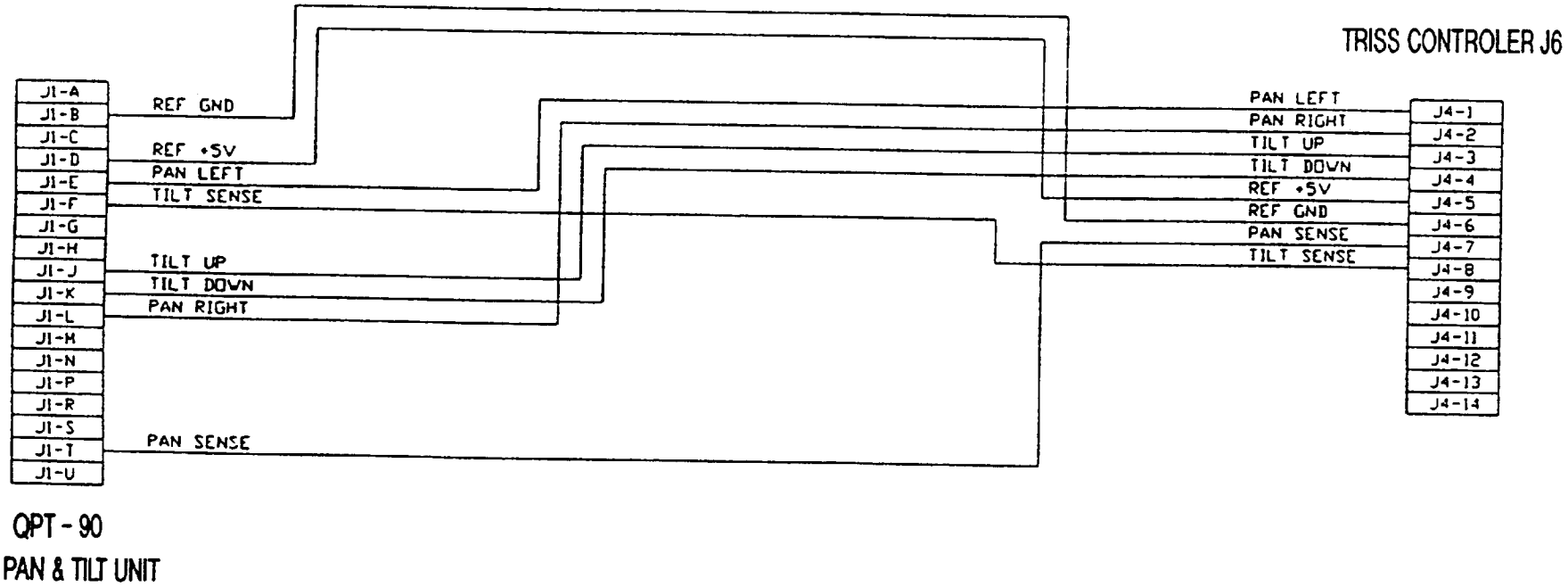

FIG. 6 illustrates a long range infrared imager system of the invention, with controller 55, positioner 54, infrared imager 53, compass position sensor 56, and sunshade 57. FIG. 7 illustrates a second type long range laser infrared imager system of the invention, with controller 65, positioner 64, infrared imager 63, compass position sensor 66, and sunshade 67. FIG. 8 illustrates an imager site, showing the interconnections to and the central role of the controller 65, with the photoelectric generator, regulator, and batteries 62, VHF antenna 61, microwave antenna 60, flux gate compass inclinometer 69, infrared imager 63, and pan and tilt positioner 68. FIG. 9 illustrates a scoring position, with scoring and control computer 88, preferably having high speed and high resolution graphics controller 90, high speed video digitizer and overlay processor 92, high capacity digital video storage and playback system 94, interface controller 96, 166 MHz or faster Intel Pentium, Pentium Pro, or Pentium II processor 98, large format high resolution monitor 82, keyboard 84, and mouse/trackball 86. Input is received from microwave unit 81 and video switch and processor 83 and output is through VHF antenna 87, VHF transceiver 89, and control modem 91. Optionally, video input may be simultaneously stored on VHS format video recorder 85 or the like.

Software, such as that disclosed in the provisional patent application from which priority is claimed, is employed to control the entire system during a mission. FIGS. 10–21 illustrate the types of screens useful in any software according to the invention. Attention is particularly drawn to FIG. 12, which illustrates one embodiment of the main control screen during a mission. In this example, two remote imagers are being viewed and controlled simultaneously, while other setups will allow varying numbers of imagers. Specialized hardware useful in the present invention are shown in FIGS. 23–34.

The following are preferred requirements of the integrated controller for infrared imager sites of the invention:

Power Input:

| | |
|---|---|
| Imager Power | 12 VDC 2 A |
| Pan&Tilt Power | 12 VDC to 28 VDC 2 A |
| Controller power | 12 VDC 0.18A |
| Radio Power | 12 VDC 0.06 A Receive<br>12 VDC 0.90 A Transmit |
| Auxiliary Power | 220 VDC/AC 10.0 A |

Position Control

| | |
|---|---|
| Azimuth Motor Control | Variable from 0% to 1Q0% |
| Azimuth Motor Drive | 6 VDC to 28 VDC 2 A |
| Elevation Motor Control | Variable from 0% to 100% |
| Elevation Motor Drive | 6 VDC to 28 VDC 2 A |

Position Sensing

| | |
|---|---|
| Coupled Potentiometer | 1.5° Resolution from Rotational Stop<br>1.0° Inclination from Horizontal |
| Standard Compass | 1.0° Resolution from Magnetic North<br>1.0° Inclination from Horizontal |
| High Resolution Compass | 0.1° Resolution from Magnetic North<br>0.1° Inclination from Horizontal |

Imager Control

| | |
|---|---|
| Power | Off On (switchable) |
| Cool Down | Status Indication Reportable |
| Sensitivity | −5 VDC to +5 VDC (continuously variable) |
| Field of View | Narrow or Wide (switchable) |
| Electro-optical Zoom | ×1 ×2 ×4 or continuous zoom (switchable) |
| Width Calibration | −5 VDC to +5 VDC (absolute sewing) |
| Phase Calibration | −5 VDC to +SVDC (absolute setting) |
| Contrast | Low Medium High (switchable) or<br>−5 VDC to +5 VDC (continuously variable) |
| Polarity | Black Hot/White Hot (switchable) |
| Focus | Wide FOV Near/Far (relative setting)<br>Narrow FOV Near/Far (relative setting) |
| Case Temperature | Status Indication Reportable |

Control Addressability

| | |
|---|---|
| Discrete Addresses | 225 individually addressable controllers |
| Broadcast | To all 225 controllers at the same time |
| Group Address | 25 assignable subgroup addresses |

Preset Locations

| | |
|---|---|
| Stored Presets | 50 presets stored in non-volatile memory |
| Download | Real time down load of Azimuth, Elevation, Field of View, Contrast, Polarity, Sensitivity, and Focus |

Status (read back when a bi-directional communication link is used)

The following status conditions may preferably be read back on command: Azimuth, Elevation, Field of View, Contrast, Polarity, Sensitivity, Focus, Power Supply Voltage, Temperature, Ambient Light Condition, User Designated Alarm Conditions Communications Link

| | |
|---|---|
| Direct Interface | RS-232<br>RS-422/485 (optional) |
| Modem (optional) | Internal 300 Baud to 2400 Baud |
| Radio (optional) | VHF or UMF Transceiver |

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

What is claimed is:

1. A military range scoring apparatus comprising:

a plurality of imagers capable of viewing a plurality of reference points and impact points for ordinance aimed at the reference points;

remote means for controlling said imagers and for processing and viewing data received from said imagers; and means for communicating control information and data between said imagers and said remote means, wherein said controlling means comprise a positioner used to aim an imager at a reference point by changing azimuth and elevation of said imager.

2. The apparatus of claim 1 wherein said remote means comprises a video monitor.

3. The apparatus of claim 1 wherein said data comprise video images calibrated for angular displacement across a horizontal axis.

4. The apparatus of claim 1 additionally comprising means to measure a calibrated angular displacement between the reference point and an impact point without a requirement for detailed survey data.

5. The apparatus of claim 1 additionally comprising means for calculating a displacement between the reference point and an impact point, wherein said displacement is selected from the group consisting of X and Y displacement and azimuth and distance displacement.

6. The apparatus of claim 1 wherein said communicating means comprise means selected from the group consisting of microwave, radio, fiber optic line, and wire line.

7. The apparatus of claim 1 additionally comprising a database of reference points and imager locations to allow rapid and accurate calculation of impact points.

8. The apparatus of claim 1 wherein said imagers comprise imagers sensitive to infrared radiation.

9. The apparatus of claim 8 wherein said infrared imagers comprise means for sensing laser radiation used to target and guide smart weapons.

10. The apparatus of claim 1 wherein said imagers comprise flux gate compasses used to sense imager horizontal pointing angle, to allow accurate horizontal positioning and status information provided to said controlling means.

11. The apparatus of claim 1 wherein said imagers comprise inclinometers used to sense imager vertical pointing angle, to allow accurate vertical positioning and status information provided to said controlling means.

12. The apparatus of claim 1 wherein said controlling means comprises a computer storing imager pointing, setup, and calibration data for multiple reference points, and means for setting imager parameters including field of view, zoom, focus, sensitivity, and contrast.

13. The apparatus of claim 1 additionally comprising computer means for automatically scoring proximities of impact points to reference points.

14. The apparatus of claim 13 wherein said computer means comprises means to cause said controlling means to direct imagers to point at a reference point, means to read back calibration data from said imagers, and enter said calibration data into scoring calculations so that manual calibration is not required.

15. The apparatus of claim 1 wherein said means for viewing data comprises means for digitizing a video image.

16. The apparatus of claim 15 wherein said processing means comprises digital signal processing means for determining angular offsets and scoring an impact point from said digitized video image.

17. The apparatus of claim 16 wherein said digital signal processing means comprise means for detecting multiple impacts and scoring impact points without user intervention.

18. The apparatus of claim 15 additionally comprising means for storing and retrieving said digitized video image.

19. A military range scoring apparatus comprising:

a plurality of imagers capable of viewing a plurality of reference points and impact points for ordinance aimed at the reference points;

remote means for controlling said imagers and for processing and viewing data received from said imagers; and means for communicating control information and data between said imagers and said remote means;

wherein said imagers comprise flux gate compasses used to sense imager horizontal pointing angle, to allow accurate horizontal positioning and status information provided to said controlling means.

20. The apparatus of claim 19 wherein said remote means comprises a video monitor.

21. The apparatus of claim 19 wherein said data comprise video images calibrated for angular displacement across a horizontal axis.

22. The apparatus of claim 19 additionally comprising means to measure a calibrated angular displacement between the reference point and an impact point without a requirement for detailed survey data.

23. The apparatus of claim 19 additionally comprising means for calculating a displacement between the reference point and an impact point, wherein said displacement is selected from the group consisting of X and Y displacement and azimuth and distance displacement.

24. The apparatus of claim 19 wherein said communicating means comprise means selected from the group consisting of microwave, radio, fiber optic line, and wire line.

25. The apparatus of claim 19 wherein said controlling means comprise a positioner used to aim an imager at a reference point by changing azimuth and elevation of said imager.

26. The apparatus of claim 19 additionally comprising a database of reference points and imager locations to allow rapid and accurate calculation of impact points.

27. The apparatus of claim 19 wherein said imagers comprise imagers sensitive to infrared radiation.

28. The apparatus of claim 27 wherein said infrared imagers comprise means for sensing laser radiation used to target and guide smart weapons.

29. The apparatus of claim 19 wherein said imagers comprise inclinometers used to sense imager vertical pointing angle, to allow accurate vertical positioning and status information provided to said controlling means.

30. The apparatus of claim 19 wherein said controlling means comprises a computer storing imager pointing, setup, and calibration data for multiple reference points, and means for setting imager parameters including field of view, zoom, focus, sensitivity, and contrast.

31. The apparatus of claim 19 additionally comprising computer means for automatically scoring proximities of impact points to reference points.

32. The apparatus of claim 31 wherein said computer means comprises means to cause said controlling means to direct imagers to point at a reference point, means to read back calibration data from said imagers, and enter said calibration data into scoring calculations so that manual calibration is not required.

33. The apparatus of claim 19 wherein said means for viewing data comprises means for digitizing a video image.

34. The apparatus of claim 33 wherein said processing means comprises digital signal processing means for determining angular offsets and scoring an impact point from said digitized video image.

35. The apparatus of claim 34 wherein said digital signal processing means comprise means for detecting multiple impacts and scoring impact points without user intervention.

36. The apparatus of claim 33 additionally comprising means for storing and retrieving said digitized video image.

37. A military range scoring apparatus comprising:

a plurality of imagers capable of viewing a plurality of reference points and impact points for ordinance aimed at the reference points;

remote means for controlling said imagers and for processing and viewing data received from said imagers; and means for communicating control information and data between said imagers and said remote means;

wherein said imagers comprise inclinometers used to sense imager vertical pointing angle, to allow accurate vertical positioning and status information provided to said controlling means.

38. The apparatus of claim 37 wherein said remote means comprises a video monitor.

39. The apparatus of claim 37 wherein said data comprise video images calibrated for angular displacement across a horizontal axis.

40. The apparatus of claim 37 additionally comprising means to measure a calibrated angular displacement between the reference point and an impact point without a requirement for detailed survey data.

41. The apparatus of claim 37 additionally comprising means for calculating a displacement between the reference point and an impact point, wherein said displacement is selected from the group consisting of X and Y displacement and azimuth and distance displacement.

42. The apparatus of claim 37 wherein said communicating means comprise means selected from the group consisting of microwave, radio, fiber optic line, and wire line.

43. The apparatus of claim 37 wherein said controlling means comprise a positioner used to aim an imager at a reference point by changing azimuth and elevation of said imager.

44. The apparatus of claim 37 additionally comprising a database of reference points and imager locations to allow rapid and accurate calculation of impact points.

45. The apparatus of claim 37 wherein said imagers comprise imagers sensitive to infrared radiation.

46. The apparatus of claim 45 wherein said infrared imagers comprise means for sensing laser radiation used to target and guide smart weapons.

47. The apparatus of claim 37 wherein said imagers comprise flux gate compasses used to sense imager horizontal pointing angle, to allow accurate horizontal positioning and status information provided to said controlling means.

48. The apparatus of claim 37 wherein said controlling means comprises a computer storing imager pointing, setup, and calibration data for multiple reference points, and means for setting imager parameters including field of view, zoom, focus, sensitivity, and contrast.

49. The apparatus of claim 37 additionally comprising computer means for automatically scoring proximities of impact points to reference points.

50. The apparatus of claim 49 wherein said computer means comprises means to cause said controlling means to direct imagers to point at a reference point, means to read back calibration data from said imagers, and enter said calibration data into scoring calculations so that manual calibration is not required.

51. The apparatus of claim 37 wherein said means for viewing data comprises means for digitizing a video image.

52. The apparatus of claim 51 wherein said processing means comprises digital signal processing means for determining angular offsets and scoring an impact point from said digitized video image.

53. The apparatus of claim 52 wherein said digital signal processing means comprise means for detecting multiple impacts and scoring impact points without user intervention.

54. The apparatus of claim 51 additionally comprising means for storing and retrieving said digitized video image.

55. A military range scoring apparatus comprising:

a plurality of imagers capable of viewing a plurality of reference points and impact points for ordinance aimed at the reference points;

remote means for controlling said imagers and for processing and viewing data received from said imagers; and means for communicating control information and data between said imagers and said remote means;

wherein said controlling means comprises a computer storing imager pointing, setup, and calibration data for multiple reference points, and means for setting imager parameters including field of view, zoom, focus, sensitivity, and contrast.

56. The apparatus of claim 55 wherein said remote means comprises a video monitor.

57. The apparatus of claim 55 wherein said data comprise video images calibrated for angular displacement across a horizontal axis.

58. The apparatus of claim 55 additionally comprising means to measure a calibrated angular displacement between the reference point and an impact point without a requirement for detailed survey data.

59. The apparatus of claim 55 additionally comprising means for calculating a displacement between the reference point and an impact point, wherein said displacement is selected from the group consisting of X and Y displacement and azimuth and distance displacement.

60. The apparatus of claim 55 wherein said communicating means comprise means selected from the group consisting of microwave, radio, fiber optic line, and wire line.

61. The apparatus of claim 55 wherein said controlling means comprise a positioner used to aim an imager at a reference point by changing azimuth and elevation of said imager.

62. The apparatus of claim 55 additionally comprising a database of reference points and imager locations to allow rapid and accurate calculation of impact points.

63. The apparatus of claim 55 wherein said imagers comprise imagers sensitive to infrared radiation.

64. The apparatus of claim 63 wherein said infrared imagers comprise means for sensing laser radiation used to target and guide smart weapons.

65. The apparatus of claim 55 wherein said imagers comprise flux gate compasses used to sense imager horizontal pointing angle, to allow accurate horizontal positioning and status information provided to said controlling means.

66. The apparatus of claim 55 wherein said imagers comprise inclinometers used to sense imager vertical pointing angle, to allow accurate vertical positioning and status information provided to said controlling means.

67. The apparatus of claim 55 additionally comprising computer means for automatically scoring proximities of impact points to reference points.

68. The apparatus of claim 67 wherein said computer means comprises means to cause said controlling means to direct imagers to point at a reference point, means to read back calibration data from said imagers, and enter said calibration data into scoring calculations so that manual calibration is not required.

69. The apparatus of claim 55 wherein said means for viewing data comprises means for digitizing a video image.

70. The apparatus of claim 69 wherein said processing means comprises digital signal processing means for determining angular offsets and scoring an impact point from said digitized video image.

71. The apparatus of claim 70 wherein said digital signal processing means comprise means for detecting multiple impacts and scoring impact points without user intervention.

72. The apparatus of claim 69 additionally comprising means for storing and retrieving said digitized video image.

73. A military range scoring apparatus comprising:

a plurality of imagers capable of viewing a plurality of reference points and impact points for ordinance aimed at the reference points;

remote means for controlling said imagers and for processing and viewing data received from said imagers;

means for communicating control information and data between said imagers and said remote means; and computer means for automatically scoring proximities of impact points to reference points;

wherein said computer means comprises means to cause said controlling means to direct imagers to point at a reference point, means to read back calibration data from said imagers, and enter said calibration data into scoring calculations so that manual calibration is not required.

74. The apparatus of claim 73 wherein said remote means comprises a video monitor.

75. The apparatus of claim 73 wherein said data comprise video images calibrated for angular displacement across a horizontal axis.

76. The apparatus of claim 73 additionally comprising means to measure a calibrated angular displacement between the reference point and an impact point without a requirement for detailed survey data.

77. The apparatus of claim 73 additionally comprising means for calculating a displacement between the reference point and an impact point, wherein said displacement is selected from the group consisting of X and Y displacement and azimuth and distance displacement.

78. The apparatus of claim 73 wherein said communicating means comprise means selected from the group consisting of microwave, radio, fiber optic line, and wire line.

79. The apparatus of claim 73 wherein said controlling means comprise a positioner used to aim an imager at a reference point by changing azimuth and elevation of said imager.

80. The apparatus of claim 73 additionally comprising a database of reference points and imager locations to allow rapid and accurate calculation of impact points.

81. The apparatus of claim 73 wherein said imagers comprise imagers sensitive to infrared radiation.

82. The apparatus of claim 81 wherein said infrared imagers comprise means for sensing laser radiation used to target and guide smart weapons.

83. The apparatus of claim 73 wherein said imagers comprise flux gate compasses used to sense imager horizontal pointing angle, to allow accurate horizontal positioning and status information provided to said controlling means.

84. The apparatus of claim 73 wherein said imagers comprise inclinometers used to sense imager vertical pointing angle, to allow accurate vertical positioning and status information provided to said controlling means.

85. The apparatus of claim 73 wherein said controlling means comprises a computer storing imager pointing, setup, and calibration data for multiple reference points, and means for setting imager parameters including field of view, zoom, focus, sensitivity, and contrast.

86. The apparatus of claim 73 wherein said means for viewing data comprises means for digitizing a video image.

87. The apparatus of claim 86 wherein said processing means comprises digital signal processing means for determining angular offsets and scoring an impact point from said digitized video image.

88. The apparatus of claim 87 wherein said digital signal processing means comprise means for detecting multiple impacts and scoring impact points without user intervention.

89. The apparatus of claim 86 additionally comprising means for storing and retrieving said digitized video image.

90. A military range scoring apparatus comprising:

a plurality of imagers capable of viewing a plurality of reference points and impact points for ordinance aimed at the reference points;

remote means for controlling said imagers and for processing and viewing data received from said imagers; and means for communicating control information and data between said imagers and said remote means;

wherein said means for viewing data comprises means for digitizing a video image;

wherein said processing means comprises digital signal processing means for determining angular offsets and scoring an impact point from said digitized video image; and wherein said digital signal processing means comprise means for detecting multiple impacts and scoring impact points without user intervention.

91. The apparatus of claim 90 wherein said remote means comprises a video monitor.

92. The apparatus of claim 90 wherein said data comprise video images calibrated for angular displacement across a horizontal axis.

93. The apparatus of claim 90 additionally comprising means to measure a calibrated angular displacement between the reference point and an impact point without a requirement for detailed survey data.

94. The apparatus of claim 90 additionally comprising means for calculating a displacement between the reference point and an impact point, wherein said displacement is selected from the group consisting of X and Y displacement and azimuth and distance displacement.

95. The apparatus of claim 90 wherein said communicating means comprise means selected from the group consisting of microwave, radio, fiber optic line, and wire line.

96. The apparatus of claim 90 wherein said controlling means comprise a positioner used to aim an imager at a reference point by changing azimuth and elevation of said imager.

97. The apparatus of claim 90 additionally comprising a database of reference points and imager locations to allow rapid and accurate calculation of impact points.

98. The apparatus of claim 90 wherein said imagers comprise imagers sensitive to infrared radiation.

99. The apparatus of claim 98 wherein said infrared imagers comprise means for sensing laser radiation used to target and guide smart weapons.

100. The apparatus of claim 90 wherein said imagers comprise flux gate compasses used to sense imager horizontal pointing angle, to allow accurate horizontal positioning and status information provided to said controlling means.

101. The apparatus of claim 90 wherein said imagers comprise inclinometers used to sense imager vertical pointing angle, to allow accurate vertical positioning and status information provided to said controlling means.

102. The apparatus of claim 90 wherein said controlling means comprises a computer storing imager pointing, setup, and calibration data for multiple reference points, and means for setting imager parameters including field of view, zoom, focus, sensitivity, and contrast.

103. The apparatus of claim 90 additionally comprising computer means for automatically scoring proximities of impact points to reference points.

104. The apparatus of claim 103 wherein said computer means comprises means to cause said controlling means to direct imagers to point at a reference point, means to read back calibration data from said imagers, and enter said calibration data into scoring calculations so that manual calibration is not required.

105. The apparatus of claim 104 additionally comprising means for storing and retrieving said digitized video image.

* * * * *

UNITED STATES PATENT AND TRADEMARK OFFICE

CERTIFICATE OF CORRECTION

PATENT NO. : 5,999,210

DATED : December 7, 1999

INVENTOR(S) : ROBERT V. NEMIROFF, KEVIN P. McGOOHAN
PETE A. SIEBOLD and HENRY R. HUTSON, III It is certified that error appears in the above-indentified patent and that said Letters Patent is hereby corrected as shown below:

Title page, item

[75] Inventors should read:

--Robert V. Nemiroff; Kevin P. McGoohan; Henry R. Hutson III, all of Las Vegas; Pete A. Siebold, North Las Vegas, all of Nev.--

Signed and Sealed this

First Day of August, 2000

*Attest:*

*Attesting Officer*

Q. TODD DICKINSON

*Director of Patents and Trademarks*